US009791202B2

(12) United States Patent
Horio et al.

(10) Patent No.: US 9,791,202 B2
(45) Date of Patent: Oct. 17, 2017

(54) REFRIGERATOR AND VACUUM HEAT INSULATING MATERIAL FOR USE IN REFRIGERATOR

(75) Inventors: Yoshimasa Horio, Shiga (JP); Shinya Nagahata, Shiga (JP); Toshio Kobayashi, Kyoto (JP); Tarou Yamaguchi, Shiga (JP); Shuhei Sugimoto, Shiga (JP); Kazuya Nakanishi, Shiga (JP); Junichi Kurita, Kyoto (JP); Hiroki Hamano, Osaka (JP); Shinya Kojima, Kyoto (JP); Noriyuki Miyaji, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 710 days.

(21) Appl. No.: 13/983,507

(22) PCT Filed: Aug. 31, 2012

(86) PCT No.: PCT/JP2012/005525

§ 371 (c)(1),
(2), (4) Date: Aug. 2, 2013

(87) PCT Pub. No.: WO2013/031234

PCT Pub. Date: Mar. 7, 2013

(65) Prior Publication Data

US 2013/0313267 A1 Nov. 28, 2013

(30) Foreign Application Priority Data

Aug. 31, 2011 (JP) ..... 2011-188411
Sep. 5, 2011 (JP) ..... 2011-192672
(Continued)

(51) Int. Cl.
*B32B 1/04* (2006.01)
*B32B 3/02* (2006.01)
(Continued)

(52) U.S. Cl.
CPC ..... *F25D 11/00* (2013.01); *F25D 23/06* (2013.01); *F25D 2201/14* (2013.01)

(58) Field of Classification Search
CPC .... Y10S 220/902; Y10S 62/13; Y10S 220/18; F25D 23/064; F25D 23/062; F25D 23/066; F25D 23/06; F25D 2201/14
(Continued)

(56) References Cited

U.S. PATENT DOCUMENTS 4,469,086 A * 9/1984 Ivorra ..... F28D 20/0034 126/400
5,885,682 A 3/1999 Tanimoto et al.
(Continued)

FOREIGN PATENT DOCUMENTS

CN 1143740 2/1997
CN 1873284 12/2006
(Continued)

OTHER PUBLICATIONS

Chinese Office Action, Feb. 28, 2015, issued in corresponding Chinese Application No. 201280007737.5, together with English translation of Search Report (12 pages).

*Primary Examiner* — Allen Flanigan
*Assistant Examiner* — Filip Zec
(74) *Attorney, Agent, or Firm* — Hamre, Schumann, Mueller & Larson, P.C.

(57) ABSTRACT

The present invention provides a refrigerator with improved refrigerator box strength and high heat insulating performance, which is configured such that external deformation due to entry of air into a vacuum heat insulating material, the
(Continued)

entry of air being caused by aging degradation, is prevented. The present invention includes: a heat-insulated box including an inner casing and an outer casing, in which space between the inner casing and the outer casing is filled with a foamed heat insulating material; and a vacuum heat insulating material disposed in at least a side wall of the heat-insulated box together with the foamed heat insulating material, the vacuum heat insulating material including an outer skin material, the outer skin material including at least a core material and being decompression-sealed. The vacuum heat insulating material includes a gas adsorbent. Since the vacuum heat insulating material including the gas adsorbent is included in the side wall, which tends to be greatly distorted among the heat insulating walls of the refrigerator, the rigidity of the side wall is improved and aging degradation of the vacuum heat insulating material is suppressed. As a result, the rigidity of the heat-insulated box can be maintained for a long term, and external deformation of the outer casing of the body can be prevented.

13 Claims, 25 Drawing Sheets

(30) Foreign Application Priority Data

| | | |
|---|---|---|
| Sep. 5, 2011 | (JP) | 2011-192674 |
| Sep. 5, 2011 | (JP) | 2011-192684 |
| Oct. 18, 2011 | (JP) | 2011-228597 |
| Oct. 18, 2011 | (JP) | 2011-228599 |

(51) Int. Cl.
*F25D 19/00* (2006.01)
*F25D 11/00* (2006.01)
*F25D 23/06* (2006.01)

(58) Field of Classification Search
USPC ..... 220/592.1
See application file for complete search history.

(56) References Cited

U.S. PATENT DOCUMENTS

| | | | | |
|---|---|---|---|---|
| 6,405,556 | B1 * | 6/2002 | Bucholz | A61B 19/026 165/201 |
| 6,938,968 | B2 * | 9/2005 | Tanimoto | B65D 81/18 312/406 |
| 7,210,308 | B2 * | 5/2007 | Tanimoto | B65D 81/18 220/592.02 |
| 7,833,327 | B2 * | 11/2010 | Hirai | F25D 23/06 428/36.1 |
| 8,211,523 | B2 * | 7/2012 | Fujimori | F16L 59/065 428/69 |
| 2004/0174106 | A1 | 9/2004 | Uekado et al. | |
| 2004/0253406 | A1 * | 12/2004 | Hayashi | E04B 1/803 428/69 |
| 2005/0175809 | A1 * | 8/2005 | Hirai | F16L 59/065 428/69 |
| 2011/0290808 | A1 * | 12/2011 | Bai | F25C 5/005 220/592.09 |

FOREIGN PATENT DOCUMENTS

| | | |
|---|---|---|
| CN | 101660648 | 3/2010 |
| CN | 201487481 U | 5/2010 |
| JP | 01-102288 | 4/1989 |
| JP | 06-159922 | 6/1994 |
| JP | 11-108547 | 4/1999 |
| JP | 2000-128256 | 5/2000 |
| JP | 2002-277156 | 9/2002 |
| JP | 2005-127602 | 5/2005 |
| JP | 2006-046512 | 2/2006 |
| JP | 2006-112439 | 4/2006 |
| JP | 2006-125804 | 5/2006 |
| JP | 2006-189207 | 7/2006 |
| JP | 2006-242439 | 9/2006 |
| JP | 2007-178080 | 7/2007 |
| JP | 2007-198622 | 8/2007 |
| JP | 2008-128516 | 6/2008 |
| JP | 2011-149624 | 8/2011 |

* cited by examiner

REFRIGERATOR AND VACUUM HEAT INSULATING MATERIAL FOR USE IN REFRIGERATOR

TECHNICAL FIELD

The present invention relates to refrigerators to which vacuum heat insulating materials are applied.

BACKGROUND ART

In recent years, one effective way to realize energy and space saving of refrigerators is to improve the heat insulating performance of refrigerators. As one method for improving the heat insulating performance of refrigerators, it is proposed to utilize vacuum heat insulating materials having high heat insulating performance. Since demands for energy saving are particularly increasing nowadays, it is the urgent need to improve the heat insulating performance of refrigerators by suitably utilizing and making the most of vacuum heat insulating materials whose heat insulating performance is several to ten times as great as the heat insulating performance of rigid urethane foam.

Conventional refrigerators including vacuum heat insulating materials are disclosed in Patent Literatures 1 to 4, for example. FIG. 25 is a front cross-sectional view of a refrigerator disclosed in Patent Literature 1. The refrigerator includes a box-shaped refrigerator body 1 and a door (not shown) for opening and closing a front opening of the refrigerator body 1. The refrigerator body 1 includes heat insulating walls. The heat insulating walls are formed by arranging a plurality of vacuum heat insulating materials (vacuum heat insulating panels) 39 and 40 in space formed between a composite resin inner casing 25 and a steel plate outer casing 24 surrounding the inner casing 25, and filling the space with rigid urethane foam (urethane foam resin) 26.

Among the heat insulating walls, the thickness of both side walls is such that the thickness of thinner portions (i.e., both side walls of storage compartments 2 and 6 whose temperature is relatively high) is approximately 30 mm, and the thickness of thicker portions (i.e., both side walls of a storage compartment 14 whose temperature is relatively low) is approximately 50 mm.

The plurality of vacuum heat insulating materials 39 and 40 include: vacuum heat insulating materials 39 disposed in close contact with faces of the outer casing; and a vacuum heat insulating material 40 disposed in close contact with faces of the inner casing. Each of the vacuum heat insulating materials 39 and 40 is formed to have a thickness of approximately 10 mm. The vacuum heat insulating materials 39 are flat plate-shaped, and are disposed at the outer casing side in a manner to extend to the vicinity of outer casing corners 41 at the left and right ends of the bottom surface. The vacuum heat insulating material 40 is provided so as to cover inner casing corners connected to the bottom surface of the inner casing 25, the inner casing corners facing the outer casing corners 41. Further, the vacuum heat insulating material 40 is disposed in a manner to extend along the faces of the inner casing, such that the vacuum heat insulating material 40 overlaps the vacuum heat insulating materials 39 when seen in the thickness direction of the side walls.

CITATION LIST

Patent Literature

PTL 1: Japanese Laid-Open Patent Application Publication No. 2006-242439

PTL 2: Japanese Laid-Open Patent Application Publication No. 2007-198622

PTL 3: Japanese Laid-Open Patent Application Publication No. 2005-127602

PTL 4: Japanese Laid-Open Patent Application Publication No. 6-159922

SUMMARY OF INVENTION

Technical Problem

However, the refrigerator disclosed in the above conventional example has a problem that although the heat insulating performance of the refrigerator is high, the strength thereof is very low since all of the vacuum heat insulating materials used in the refrigerator are inferior in terms of strength to the rigid urethane foam which is disposed in close contact with the outer casing and the inner casing.

Moreover, as a result of the recent trend in the refrigerator industry for the refrigerator's space saving and interior volume increase, an interior volume increase of approximately 100 L has been achieved compared to nearly a decade ago under the condition of the same external dimensions of the refrigerator. Such an interior volume increase has been realized through efforts to eliminate dead space in the refrigerator and to improve the heat insulating performance of the refrigerator box while reducing the thickness of the walls. In order to arrange a vacuum heat insulating material at the inner casing side and a vacuum heat insulating material at the outer casing side such that the vacuum heat insulating materials overlap each other as in the above-described conventional example, the walls need to be sufficiently thick. For example, if the thickness of each vacuum heat insulating material is approximately 10 mm, then the wall thickness at a portion where the vacuum heat insulating materials overlap each other needs to be 40 mm or more considering the thickness of the rigid urethane foam filling (in the above conventional example, 50 mm). For this reason, a further increase in refrigerator interior volume has been difficult.

In view of the above problems, the present invention provides a refrigerator with improved refrigerator box strength and high heat insulating performance, which is configured such that external deformation due to entry of air into a vacuum heat insulating material, the entry of air being caused by aging degradation, is prevented.

Solution to Problem

In order to solve the above conventional problems, a refrigerator according to the present invention includes: a heat-insulated box including an inner casing and an outer casing, in which space between the inner casing and the outer casing is filled with a foamed heat insulating material; and a vacuum heat insulating material disposed in the heat-insulated box together with the foamed heat insulating material, the vacuum heat insulating material including an outer skin material, the outer skin material including at least a core material and being decompression-sealed. The vacuum heat insulating material includes a gas adsorbent, and the vacuum heat insulating material is included in at least a side wall of the heat-insulated box.

Thus, according to the present invention, the vacuum heat insulating material including the gas adsorbent is included in the side wall which tends to receive the greatest load among the heat insulating walls of the refrigerator due to influence of a door and the like. As a result, the rigidity of the entire heat-insulated box is improved and aging degradation of the vacuum heat insulating material is suppressed. Therefore, the rigidity of the heat-insulated box can be maintained for a long term.

Advantageous Effects of Invention

The present invention provides a refrigerator with improved refrigerator box strength and high heat insulating performance, which is configured such that external deformation due to entry of air into a vacuum heat insulating material, the entry of air being caused by aging degradation, is prevented.

DESCRIPTION OF EMBODIMENTS

Figure 1:
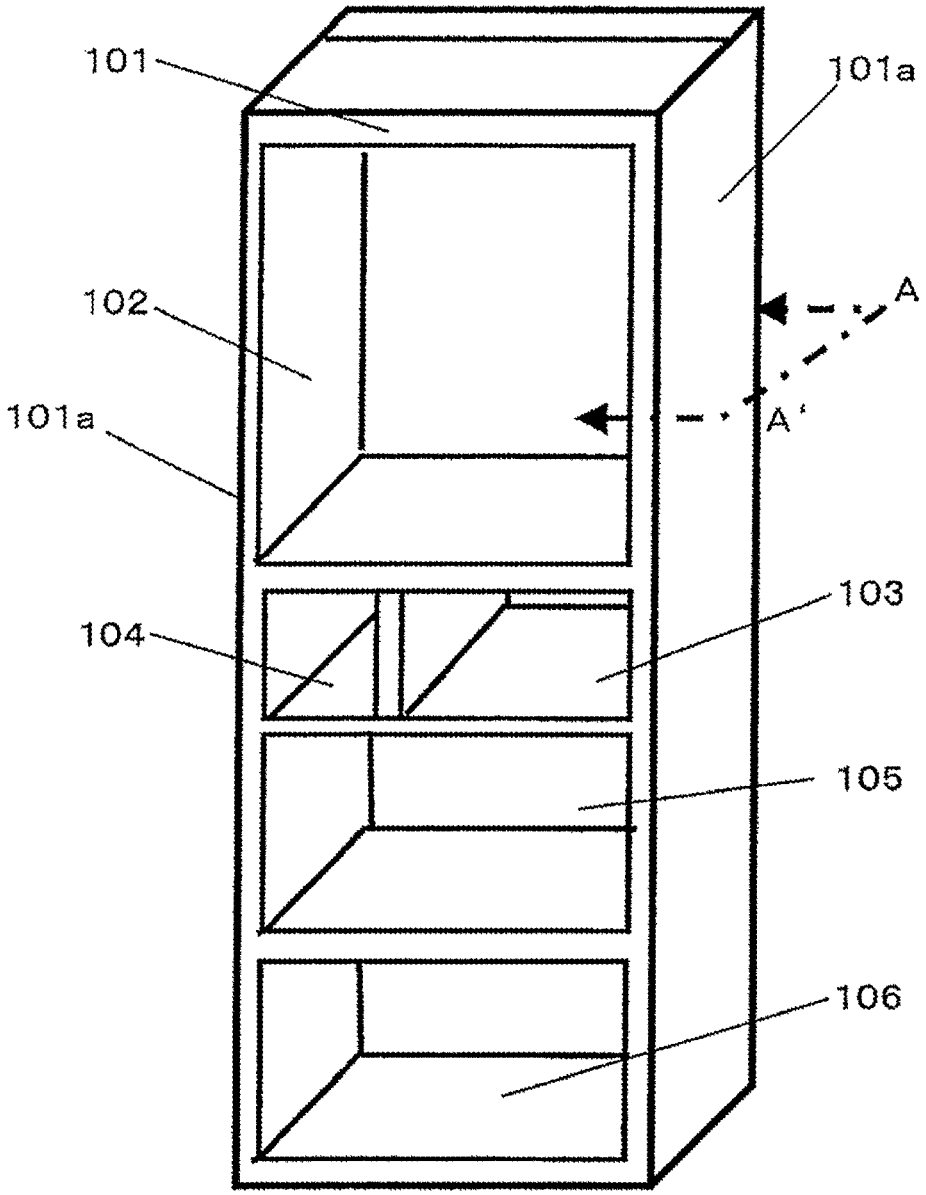
FIG. 1 is a perspective view of a refrigerator according to Embodiment 1 of the present invention.

A first aspect of the present invention is a refrigerator including: a heat-insulated box including an inner casing and an outer casing, in which space between the inner casing and the outer casing is filled with a foamed heat insulating material; and a vacuum heat insulating material disposed in at least a side wall of the heat-insulated box together with the foamed heat insulating material, the vacuum heat insulating material including an outer skin material, the outer skin material including at least a core material and being decompression-sealed. The vacuum heat insulating material includes a gas adsorbent.

Thus, since the vacuum heat insulating material including the gas adsorbent is, together with the foamed heat insulating material, included in the side wall which tends to be greatly distorted among the heat insulating walls of the refrigerator, the rigidity of the side wall is improved and aging degradation of the vacuum heat insulating material is suppressed. As a result, the rigidity of the heat-insulated box can be maintained for a long term.

In a second aspect of the present invention, the vacuum heat insulating material is plate-shaped. The vacuum heat insulating material including the gas adsorbent is disposed in both left and right side walls of the heat-insulated box. A main surface of the vacuum heat insulating material disposed in the left side wall has an area equal to that of a main surface of the vacuum heat insulating material disposed in the right side wall.

Accordingly, the rigidity of the left side wall and the rigidity of the right side wall of the refrigerator can be made to be the same, which eliminates unbalanced rigidity in the heat-insulated box and makes it possible to form a well-balanced heat-insulated box with stable strength.

In a third aspect of the present invention, the vacuum heat insulating material including the gas adsorbent is disposed in a back wall of the heat-insulated box.

Accordingly, in addition to the rigidity of the side walls of the refrigerator, the rigidity of the back wall connecting the left and right side walls is increased. Thus, the rigidity of the heat-insulated box can be further increased.

In a fourth aspect of the present invention, a lower end of the vacuum heat insulating material disposed in the side wall has a core-less portion formed solely of the outer skin material, the core-less portion not including the core material. The core-less portion is folded back to form a multi-layered portion, and the gas adsorbent is positioned away from the multi-layered portion.

Accordingly, the multi-layered portion formed solely of the outer skin material, the outer skin material having relatively high thermal conductivity in the vacuum heat insulating material, tends to exhibit a great temperature variation. However, by disposing the gas adsorbent at a position away from the multi-layered portion, a variation in the temperature of the gas adsorbent can be suppressed. As a result, the gas adsorption amount is stabilized, and thereby aging degradation can be suppressed.

In a fifth aspect of the present invention, the heat-insulated box is provided with a heat generating portion, and the gas adsorbent included in the vacuum heat insulating material is positioned not to be adjacent to the heat generating portion of the heat-insulated box.

Accordingly, the temperature of the gas adsorbent included in the vacuum heat insulating material is prevented from becoming a high temperature, so that the gas adsorbent is prevented from becoming highly activated in a short term, and thus the gas adsorbent is allowed to exert its function for a long term. Further, aging degradation of the outer skin material around the gas adsorbent is prevented, and thereby influence on the gas adsorbent due to its contact with air can be reduced. As a result, even in a case where the heat-insulated box is used for a long term, the gas adsorbent included in the vacuum heat insulating material is able to continuously adsorb air that enters from the outside. This makes it possible to maintain the degree of vacuum of the vacuum heat insulating material, and to suppress degradation in the thermal conductivity of the vacuum heat insulating material.

In a sixth aspect of the present invention, the heat-insulated box is provided with a heat generating portion. The gas adsorbent included in the vacuum heat insulating material is positioned not to overlap the heat generating portion of the heat-insulated box in a thickness direction of the vacuum heat insulating material.

Accordingly, the temperature of the gas adsorbent included in the vacuum heat insulating material is prevented from becoming a high temperature, so that the gas adsorbent is prevented from becoming highly activated in a short term, and thus the gas adsorbent is allowed to exert its function for a long term. Further, aging degradation of the outer skin material around the gas adsorbent is prevented, and thereby influence on the gas adsorbent due to its contact with air can be reduced. As a result, even in a case where the heat-insulated box is used for a long term, the gas adsorbent included in the vacuum heat insulating material is able to continuously adsorb air that enters from the outside. This makes it possible to maintain the degree of vacuum of the vacuum heat insulating material, and to suppress degradation in the thermal conductivity of the vacuum heat insulating material.

In a seventh aspect of the present invention, the heat-insulated box is provided with a refrigeration cycle, the refrigeration cycle including a compressor, heat radiation piping included in a condenser, a capillary tube, and a cooling device. The heat generating portion is the heat radiation piping.

Accordingly, heat generated by the heat radiation piping highly heated in the refrigeration cycle, the heat having a temperature higher than the outdoor temperature, can be suppressed from being transmitted to the gas adsorbent. As a result, the gas adsorbent can be prevented from becoming a heat spot.

Moreover, even if the gas adsorbent protrudes from the vacuum heat insulating material, the surface of the vacuum heat insulating material in the body at the outer casing side does not protrude, and thus external deformation can be prevented.

Furthermore, deformation of the vacuum heat insulating material which is maintained to be in a low-vacuum state, the deformation being caused due to entry of air into the vacuum heat insulating material, can be prevented. This makes it possible to prevent external deformation of the outer casing of the refrigerator body.

In an eighth aspect of the present invention, the heat radiation piping is disposed on a surface of the vacuum heat insulating material, and the gas adsorbent is disposed between at least two heat radiation pipes of the heat radiation piping.

Accordingly, a local portion that cannot be insulated does not occur in the vacuum heat insulating material. This makes it possible to enhance heat radiation performance and improve energy saving performance.

In a ninth aspect of the present invention, the gas adsorbent is disposed on a surface of the vacuum heat insulating material, the surface being positioned at an opposite side to the surface on which the heat radiation piping is disposed.

Accordingly, the heat radiation piping and the gas adsorbent are assuredly positioned on the opposite surfaces of the vacuum heat insulating material, respectively, with the core material positioned therebetween. This makes it possible to reduce thermal influence on the gas adsorbent from the heat radiation piping.

In a tenth aspect of the present invention, the heat-insulated box includes a door including an internal door plate and an external door plate. Space between the internal door plate and the external door plate is filled with a foamed heat insulating material, and a vacuum heat insulating material including an outer skin material, the outer skin material including at least a core material and being decompression-sealed, is disposed in the space. The vacuum heat insulating material includes a gas adsorbent.

Accordingly, since the vacuum heat insulating material includes the gas adsorbent, the vacuum heat insulating material is capable of suppressing its aging degradation. Therefore, improved rigidity of the door can be maintained for a long term, and thus the strength of the door can be improved.

In a case where sufficient strength is already obtained, the use of the vacuum heat insulating material including the gas adsorbent allows the wall thickness to be reduced while maintaining the strength. This makes it possible to increase the interior volume. Since the wall thickness is reduced, the usage amount of rigid urethane foam can be reduced, and also, the weight of a final product can be reduced.

In an eleventh aspect of the present invention, the heat-insulated box includes a plurality of the doors, and the vacuum heat insulating material including the gas adsorbent is disposed in a door having a largest area among the plurality of the doors.

In general, when a door having a large area is used for a long term, there is a possibility that deformation such as a warp occurs at the inside and the outside of the door. However, according to the present invention, the vacuum heat insulating material including the gas adsorbent is capable of suppressing the aging degradation of the vacuum heat insulating material. Accordingly, improved rigidity of the door can be maintained for a long term, and thereby the strength of the door can be improved. This makes it possible to prevent a decrease in cooling efficiency that is caused by, for example, cool air leakage due to deformation of the door. As a result, an energy-efficient refrigerator can be provided.

In a twelfth aspect of the present invention, the external door plate of the door includes a notched portion, and the vacuum heat insulating material including the gas adsorbent is disposed such that the vacuum heat insulating material overlaps at least part of the notched portion when the door is seen in a thickness direction thereof.

Generally speaking, installation of an external door plate including a notched portion may cause a risk that the strength of the door decreases. However, according to the present invention, the strength of the door can be improved by including the vacuum heat insulating material including the gas adsorbent, such that the vacuum heat insulating material overlaps at least part of the notched portion when the door is seen in the thickness direction thereof, and thus a highly reliable refrigerator can be provided.

In a thirteenth aspect of the present invention, the heat-insulated box includes a plurality of vacuum heat insulating materials having different respective degrees of vacuum.

Generally speaking, the degree of vacuum of the vacuum heat insulating material is determined by the amount of gas sucked to the outside from the inside of the outer skin material of the vacuum heat insulating material, or by the adsorption performance of the gas adsorbent. The degree of vacuum, rigidity, and thermal conductivity of the vacuum heat insulating material are correlated with each other. If the vacuum heat insulating material has a high degree of vacuum, then the rigidity thereof is high and the thermal conductivity thereof is low. In contrast, if the vacuum heat insulating material has a low degree of vacuum, then the rigidity thereof is low and the thermal conductivity thereof is high. Therefore, the strength of the body of the refrigerator can be increased by using the vacuum heat insulating material having a high degree of vacuum at portions where the strength is required to be increased.

In a fourteenth aspect of the present invention, a vacuum heat insulating material having a greatest degree of vacuum among the plurality of vacuum heat insulating materials having different respective degrees of vacuum is a vacuum heat insulating material, in which a core material including at least a fibrous material and a gas adsorbent included in a pouch formed of a packaging material are covered by an outer skin material having gas barrier capability.

Accordingly, nitrogen which accounts for approximately 75% of air can be adsorbed at normal temperatures. This makes it possible to reduce residual air within the vacuum heat insulating material. Accordingly, the degree of vacuum and the rigidity of the vacuum heat insulating material can be improved, and the thermal conductivity of the vacuum heat insulating material can be reduced. Moreover, the gas adsorbent is capable of continuously adsorbing air entering through the outer skin material after the vacuum-sealing. This makes it possible to suppress performance degradation caused by aging degradation of the thermal conductivity of the vacuum heat insulating material, the aging degradation being caused when air has entered the inside of the vacuum heat insulating material due to elapse of time. Thus, high heat insulating performance can be maintained for a long term.

In a fifteenth aspect of the present invention, a top surface and a back surface of the heat-insulated box are demarcated by a first top surface portion and a first back surface portion, respectively, and a recess is formed in a top portion of the heat-insulated box at the back surface side. The recess is provided at the back surface side of the first top surface portion and positioned lower than the first top surface portion, the recess including a second top surface portion and a second back surface portion, the second top surface portion being connected to a top of the first back surface portion, the second back surface portion connecting the first top surface portion and the second top surface portion. A compressor is disposed on the second top surface portion of the recess. The vacuum heat insulating material including the gas adsorbent is disposed in the second back surface portion and/or the second top surface portion.

This realizes a refrigerator with high strength and excellent energy saving performance. In addition, the refrigerator exhibits high heat insulation capacity since the vacuum heat insulating material including the gas adsorbent is used around the machinery compartment including the compressor whose temperature is high. Therefore, exhaust heat from the compressor is suppressed from being transmitted to the interior of the refrigerator, which makes it possible to suppress an increase in the temperature of the refrigerator interior and to improve energy saving performance.

Moreover, the rigidity of the second top surface portion which supports the compressor and a machinery compartment fan is increased, and thus propagation of noise and vibration can be suppressed.

In a sixteenth aspect of the present invention, the vacuum heat insulating material including the gas adsorbent is disposed in one of heat insulating walls forming the second back surface portion and the second top surface portion, the one heat insulating wall having a less thickness than the other one of the heat insulating walls.

In this manner, the vacuum heat insulating material whose thermal conductivity is reduced owing to the gas adsorbent is affixed to the less thick heat insulating wall. As a result, a high heat insulating effect can be obtained.

Since the reduced thermal conductivity is realized, if the heat insulating performance to be obtained is the same as that of conventional art, then the thickness of the vacuum heat insulating material can be reduced. Therefore, the urethane fluidity is not hindered. Moreover, since the reduced thermal conductivity is realized, if the heat insulating performance to be obtained is the same as that of conventional art, then as an alternative method, the thickness of the rigid urethane foam may be reduced. In this case, through the reduction of the wall thickness, not only an increase in the interior volume of the refrigerator but also a reduction in the usage amount of rigid urethane foam can be realized. As a result, the cost and weight of a final product can be reduced. As a result of the weight reduction, the transportability of the product is improved.

A plurality of vacuum heat insulating materials having different rigidities and different degrees of vacuum are used at respective positions, and thereby the rigidity and strength of the body are improved. In addition, since the weight of the upper part of the body is reduced, the center of gravity of the body is lowered. As a result, overturning of the refrigerator can be advantageously prevented.

In a seventeenth aspect of the present invention, the vacuum heat insulating material including the gas adsorbent is disposed in one of heat insulating walls forming the second back surface portion and the second top surface portion, the one heat insulating wall having a larger area of projection onto an interior of the refrigerator than the other one of the heat insulating walls when each heat insulating wall is seen in a thickness direction thereof.

Accordingly, an area covered by the vacuum heat insulating material including the gas adsorbent can be made large, which makes it possible to improve energy saving performance while suppressing heat transmission to the refrigerator interior and temperature increase in the refrigerator interior. Moreover, the strength of the refrigerator can be improved, and the area of propagation of noise and vibration to the refrigerator interior can be reduced to a greater degree.

In an eighteenth aspect of the present invention, the vacuum heat insulating material including the gas adsorbent is disposed in one of heat insulating walls forming the second back surface portion and the second top surface portion, the one heat insulating wall being closer in distance to the compressor than the other one of the heat insulating walls.

In this manner, the vacuum heat insulating material including the gas adsorbent is disposed at a portion where a great temperature difference occurs. As a result, a high heat insulating effect can be obtained, and energy saving performance can be improved while suppressing transmission of exhaust heat from the compressor to the refrigerator interior and suppressing an increase in the temperature of the refrigerator interior.

Moreover, since the temperature of the gas adsorbent is increased due to an influence of the temperature of exhaust heat from the compressor, the activity of the gas adsorbent is increased and the gas adsorption effect is increased. As a result, the vacuum heat insulating material with a further increased degree of vacuum can be provided. Consequently, reduced thermal conductivity and improved strength are obtained, which realizes high energy saving performance and high external strength of the refrigerator.

A nineteenth aspect of the present invention is a vacuum heat insulating material for use in a refrigerator, which is included in the refrigerator according to any one of the first to eighteenth aspects.

Hereinafter, embodiments of the present invention are described with reference to the drawings. The present invention is not limited by these embodiments.

It should be noted that the same configurations as those of conventional art and configurations showing no difference from conventional art will not be described in detail below. The present invention is not limited by the embodiments described below.

Embodiment 1

Hereinafter, the embodiments of the present invention are described in detail with reference to the drawings.

Figure 2:
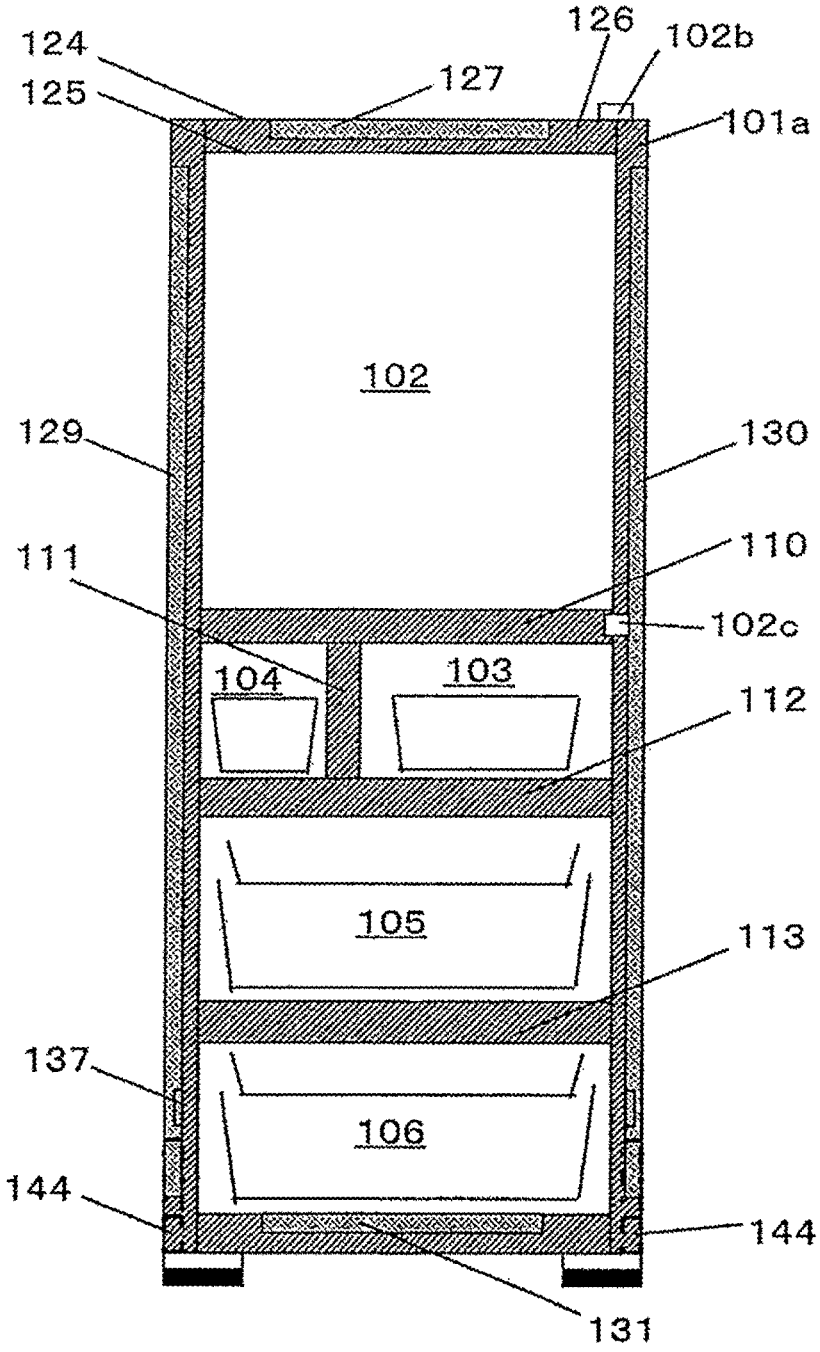
FIG. 2 is a front cross-sectional view of the refrigerator according to Embodiment 1 of the present invention.
Figure 3:
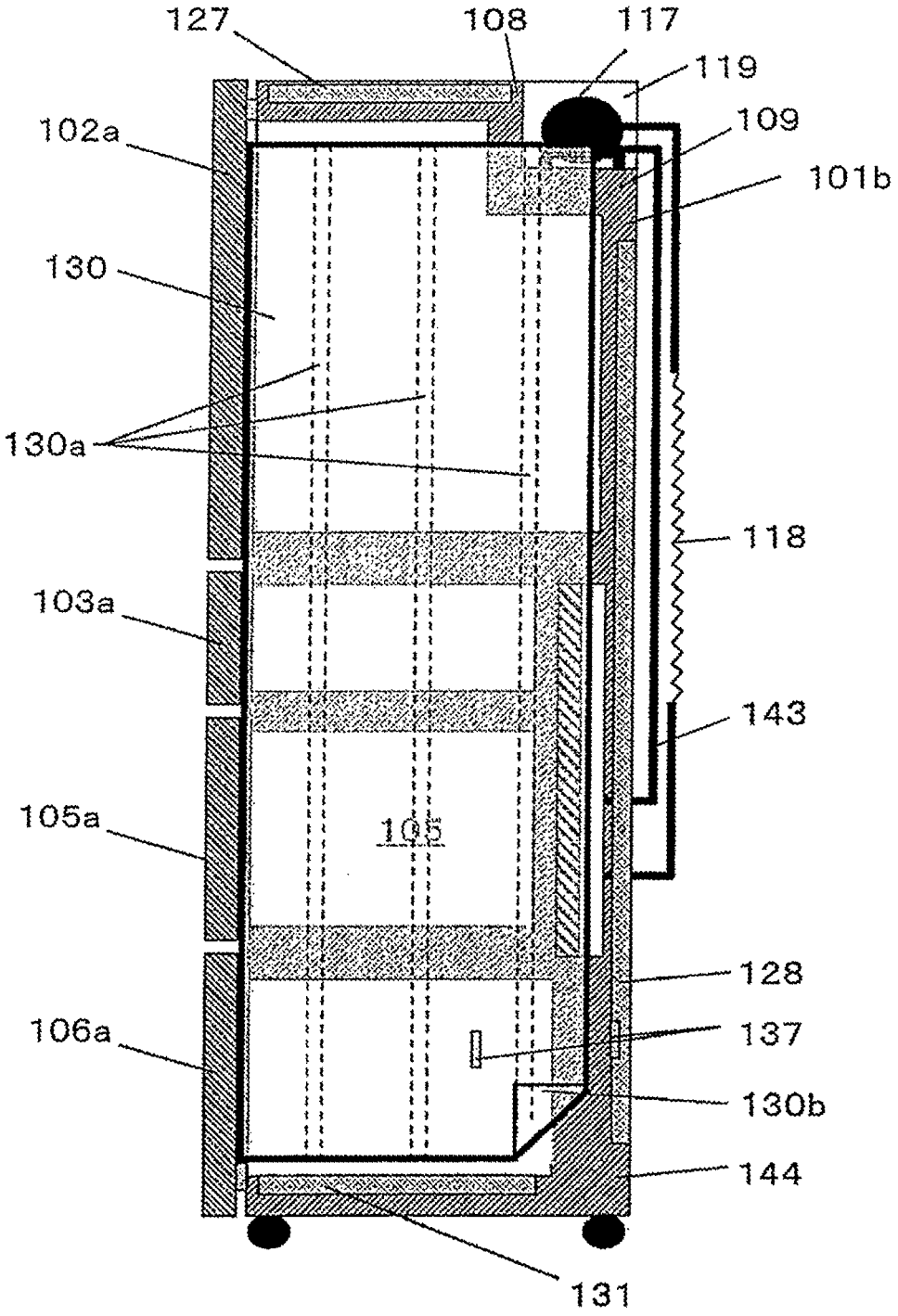
FIG. 3 is a longitudinal sectional view of a side wall of the refrigerator according to Embodiment 1 of the present invention.

FIG. 1 is a perspective view of a refrigerator according to Embodiment 1 of the present invention. FIG. 2 is a front cross-sectional view of the refrigerator according to Embodiment 1 of the present invention. FIG. 3 is a longitudinal sectional view of a side wall of the refrigerator according to Embodiment 1 of the present invention.

As shown in FIG. 1 to FIG. 3, the body 101 of the refrigerator is a heat-insulated box including: a metal (e.g., iron plate) outer casing 124 with a front opening; a hard resin (e.g., ABS) inner casing 125; and rigid urethane foam 126 which fills between the outer casing 124 and the inner casing 125. The interior of the body 101 is divided into a plurality of compartments. In the present embodiment, the body 101 includes: a refrigerator compartment 102 provided at the upper part of the body 101; an upper freezer compartment 103 provided below the refrigerator compartment 102; an ice compartment 104 provided parallel to the upper freezer compartment 103 below the refrigerator compartment 102; a vegetable compartment 106 provided at the lower part of the body; and a lower freezer compartment 105 provided between the vegetable compartment 106 and the upper freezer compartment 103 and ice compartment 104 which are arranged in parallel to each other.

The refrigerator includes a swing door 102*a* which swings to open and close the front opening of the refrigerator compartment 102. The door 102*a* is swingably attached to the body 101 via an upper hinge holder 102*b* provided at the top of the body 101 and a lower hinge 102*c* provided at the lower side of the refrigerator compartment 102.

The upper hinge holder 102*b* is provided such that at least part of the upper hinge holder 102*b* is, when seen in the vertical direction, positioned closer to the outer casing 124 of a side wall 101*a* than the inner casing 125 of the side wall 101*a*. In other words, at least part of the upper hinge holder 102*b* is, when seen in the vertical direction, positioned so as to overlap the side wall 101*a* which is formed of a heat insulating material.

Front openings of the upper freezer compartment 103, the ice compartment 104, the lower freezer compartment 105, and the vegetable compartment 106 are sealed by drawer-type doors 103*a*, 104*a*, 105*a*, and 106*a*, respectively, such that these front openings can be freely opened and closed by the respective drawer-type doors. The front opening of the refrigerator compartment 102 is sealed by the swing door 102*a*, such that the front opening can be freely opened and closed by the swing door 102*a*, which may be configured as a double door, for example.

The temperature of the refrigerator compartment 102 is normally set to fall within the range of 1° C. to 5° C. so that the lowest temperature in the range will be such a temperature as not to freeze food products that are to be refrigerated. It is often the case that the temperature of the vegetable compartment 106 is set to fall within a temperature range that is the same as or slightly higher than the temperature range of the refrigerator compartment 102, that is, often set to be in the range of 2° C. to 7° C. The lower the set temperature, the longer the freshness of leafy vegetables can be kept. The temperatures of the upper freezer compartment 103 and the lower freezer compartment 105 are normally set to fall within the range of −22° C. to −18° C. so that food products can be kept frozen. In order to improve such a frozen storage state, the temperatures of the freezers may be set to fall within a lower temperature range, for example, −30° C. to −25° C.

As described above, since the temperatures of the interiors of the refrigerator compartment 102 and the vegetable compartment 106 are set to temperatures above zero, the interiors of these compartments in such above-zero temperature ranges are referred to as a refrigerating temperature zone. Similarly, since the temperatures of the interiors of the upper freezer compartment 103, the lower freezer compartment 105, and the ice compartment 104 are set to temperatures below zero, the interiors of these compartments in such below-zero temperature ranges are referred to as a freezing temperature zone. The upper freezer compartment 103 may be configured as a temperature-switchable compartment so that the temperature zone thereof can be selected between the refrigerating temperature zone and the freezing temperature zone.

The top surface portion of the body 101 of the refrigerator includes a first top surface portion 108 and a second top surface portion 109 provided at the back of the first top surface portion 108, such that these top surface portions form a downward step toward the back surface of the refrigerator (see FIG. 3). In other words, a recess whose bottom is the second top surface portion 109 is provided at the back surface side of the top surface portion of the body 101. The recess serves as a machinery compartment 119 in which a compressor 117 is disposed. It should be noted that the recess is covered by a cover as shown in FIG. 1.

The refrigerator includes a refrigeration cycle which is formed by sequentially connecting the compressor 117, a dryer (not shown) for use in moisture removal, a condenser (not shown), heat radiation piping 143 for use in heat radiation, a capillary tube 118, and a cooling device (not shown) in a circular pattern. A cooling medium is enclosed in the refrigeration cycle, and thus a cooling operation is performed. In recent years, a combustible cooling medium is often used as the cooling medium for environmental protection purposes. It should be noted that in a case where the refrigeration cycle uses valves such as a three-way valve and a change-over valve, such functional components may be disposed in the machinery compartment.

Vacuum heat insulating materials 127, 128, 129, 130, and 131 together with the rigid urethane foam 126 form the body 101 of the refrigerator. Specifically, among these vacuum heat insulating materials, the vacuum heat insulating materials 127, 128, 129, and 130 are in contact with and affixed to the inside of the top, back, left side, and right side surfaces of the outer casing 124, respectively. The vacuum heat insulating material 131 is in contact with and affixed to the bottom surface of the inner casing 125.

The vacuum heat insulating materials 129 and 130, which are included in respective side walls 101*a*, each include a gas adsorbent 137 therein. In each of the vacuum heat insulating materials 129 and 130, the gas adsorbent 137 is disposed at a position that is, when seen in the thickness direction of each vacuum heat insulating material, closer to the interior of the refrigerator (i.e., closer to the inner casing) than the central position in the vacuum heat insulating material. The vacuum heat insulating materials 129 and 130 disposed in the respective left and right side walls 101*a* are both plate-shaped, and the area of a main surface of the vacuum heat insulating material 129 is the same as the area of a main surface of the vacuum heat insulating material 130.

Deformed portions, which extend vertically straight, are formed in each of the vacuum heat insulating materials 129 and 130 included in the side walls 101*a*. Although FIG. 3 merely shows deformed portions 130*a* formed in the vacuum heat insulating material 130 included in the right side wall 101*a*, the same is true of deformed portions formed in the vacuum heat insulating material 129 at the left side. These deformed portions are recessed portions (or groove-like portions) recessed from the outer surfaces of the vacuum heat insulating materials 129 and 130. A plurality of such deformed portions are formed in each of the vacuum heat insulating materials 129 and 130, and the deformed portions are substantially parallel to each other when seen in the horizontal direction. Further, as shown in FIG. 3, the vacuum heat insulating material 130 includes a multi-layered portion 130*b* where a core-less portion formed solely of an outer skin material, the core-less portion not including a core material, is folded back. FIG. 3 shows the multi-layered portion 130*b*, which is formed by folding back one of the four corners of the vacuum heat insulating material 130 which has a rectangular shape when seen in side view, the one corner being the lower corner at the back surface side. Such a multi-layered portion may be formed at other corners. Moreover, the multi-layered portion(s) may be similarly formed on the vacuum heat insulating material 129.

As shown in FIG. 2, the compartments of the body 101 are demarcated by partitions. Specifically, the refrigerator compartment 102 is partitioned off by a first heat insulating partition 110 from the ice compartment 104 and the upper freezer compartment 103 which are positioned below the refrigerator compartment 102. The upper freezer compartment 103 and the ice compartment 104 arranged side by side are partitioned off from each other by a second heat insulating partition 111. The upper freezer compartment 103 and the ice compartment 104 are partitioned off by a third heat insulating partition 112 from the lower freezer compartment 105 which is positioned below the compartments 103 and 104. The lower freezer compartment 105 and the vegetable compartment 106 therebelow are partitioned off from each other by a fourth heat insulating partition 113.

It should be noted that the second heat insulating partition 111 and the third heat insulating partition 112 are components to be fixed to the body 101 after the body 101 is filled with the rigid urethane foam 126. Therefore, it is conceivable that polystyrene foam is used as a heat insulating material of the second heat insulating partition 111 and the third heat insulating partition 112. Moreover, in order to improve the heat insulating performance and the rigidity of these heat insulating partitions, the rigid urethane foam 126 may be used instead. Furthermore, the thickness reduction of the partition structure may be sought after through insertion of a vacuum heat insulating material having high heat insulation capacity.

Each of the drawer-type doors of the upper freezer compartment 103 and the ice compartment 104 includes a moving part (guide mechanism) including rollers and guides. As long as the moving part is obtained, the second heat insulating partition 111 and the third heat insulating partition 112 may be formed thin or even eliminated, which makes it possible to obtain a cooling air passage and thereby improve cooling performance. Moreover, the second heat insulating partition 111 and the third heat insulating partition 112 may be hollowed out, and the resultant hollows may be used as an air passage, which makes it possible to reduce the number of materials to be used.

At the back of the body 101 of the refrigerator, there is provided a cooling chamber (not shown) formed by using, for example, aluminum and copper. Typically, a fin-and-tube cooling device configured to generate cool air is disposed in the cooling chamber. As one example, the cooling device is vertically and longitudinally disposed so as to extend behind the second and third partitions 111 and 112 which are heat-insulating partition walls and to extend along the back of the lower freezer compartment 105.

A cool air sending fan (not shown) is disposed near the cooling device (e.g., in upper space in the cooling chamber). The cool air sending fan is configured to send the cool air generated by the cooling device to the compartments 102 to 106 by means of forced convection. A glass tube radiant heater (not shown) is provided in lower space in the cooling chamber. The glass tube radiant heater serves as a defroster for removing frost that builds up on the cooling device and the cool air sending fan at the time of cooling. The specific defroster configuration is not particularly limited to the above. Instead of the radiant heater, a pipe heater disposed in close contact with the cooling device may be used as the defroster.

Next, a description is given of a cooling operation of the above-described refrigerator. For example, there is a case where the temperature of the interior of the freezer compartment 106 increases due to heat entering from the outside through the walls of the body 101 or due to heat entering when the doors are opened. In such a case, if a freezer compartment sensor (not shown) that is a temperature sensor detects a predetermined start-up temperature or a higher temperature, then the compressor 117 starts up and a cooling operation is started. A high-temperature and high-pressure cooling medium discharged from the compressor 117 radiates heat at the condenser to turn into a condensate. Then, before eventually reaching the dryer disposed in the machinery compartment 119, the condensate is cooled down and liquefied particularly in the heat radiation piping 143 disposed at the outer casing 124, by exchanging heat with air outside of the outer casing 124 and with the internal urethane foam 126, for example.

Next, the pressure of the liquefied cooling medium is reduced by the capillary tube 118 which is a decompressor, and then the cooling medium flows into the cooling device to exchange heat with air in the compartments near the cooling device. Cool air generated through the heat exchange is sent by the cool air sending fan nearby into the freezer compartment, and thereby the interior of the freezer compartment is cooled down. Thereafter, the cooling medium is heated and gasified, and then returns to the compressor 117. When the interior of the freezer compartment is cooled down and thereby the temperature detected by the freezer compartment sensor has become a stop temperature or lower, the compressor 117 stops operating.

Next, a description is given of the vacuum heat insulating material used in the present embodiment, in which the gas adsorbent 137 is used.

Figure 4:
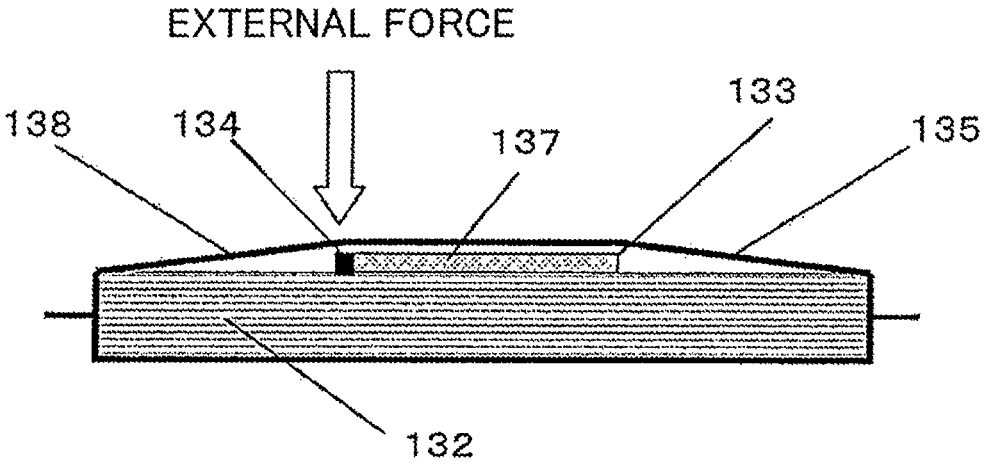
FIG. 4 is a cross-sectional view of a first vacuum heat insulating material, to which a gas adsorbent according to Embodiment 1 of the present invention is applied.

FIG. 4 shows a vacuum heat insulating material 138 which is formed in the following manner: a core material 132 including at least a fibrous material, and a powdery gas adsorbent 137 vacuum-packed in a pouch formed of a packaging material 133 having gas barrier capability, are covered with an outer skin material 135 having excellent gas barrier capability; then, the outer skin material 135 is vacuum-sealed; and thereafter a hole is formed in the packaging material 133, so that the inside of the packaging material and the inside of the outer skin material are caused to be in communication with each other. It should be noted that to be in communication with each other means that the space inside the packaging material and the space outside the packaging material are made into continuous space.

As mentioned above, the hole is formed in the packaging material 133 after the outer skin material 135 is vacuum-sealed. In the present embodiment, after the outer skin material 135 is vacuum-sealed, external force from the outside of the outer skin material 135 is applied to a destruction portion 134 which the packaging material 133 is provided with in advance. As a result, the destruction portion 134 is destroyed, and thus a hole is formed in the packaging material 133.

In such a state where the hole is open, the inner space of the outer skin material 135 is in communication with the gas adsorbent. As a result, gas remaining in the inner space of the outer skin material 135 is adsorbed by the gas adsorbent, and thus the degree of vacuum can be further increased.

As described above, according to the present embodiment, the vacuum heat insulating material in its production process is subjected to vacuum drawing and sealed, and then a gas adsorbent container is destroyed by any suitable method, so that the inside of the gas adsorbent container and the inside of the outer skin material are caused to be in communication with each other, that is, double decompressing is performed. The double decompressing makes it possible to greatly increase the degree of vacuum and also improve the rigidity of the vacuum heat insulating material including the gas adsorbent.

It should be noted that the gas adsorbent includes a ZSM-5 zeolite adsorbent in the form of a powder having a large surface area. Moreover, in order to improve nitrogen adsorbing performance at normal temperatures, it is desirable to use a ZSM-5 zeolite in which at least 60% or more of the copper sites are monovalent copper sites, and at least 70% or more of the monovalent copper sites are monovalent copper sites with three-coordinate oxygen atoms.

Thus, by including a gas adsorbent in which the proportion of monovalent copper sites with three-coordinate oxygen atoms is high, the amount of air to be adsorbed can be greatly increased.

The vacuum heat insulating material includes a core material therein. The core material is formed in the following manner: a mass of inorganic fibers such as glass wool fibers is heated and dried; then the mass of inorganic fibers is inserted into an outer skin material, which is formed by affixing a vapor deposition film and a metal thin film together; and the inside of the outer skin material is subjected to vacuum drawing and an opening thereof is sealed. The mass of inorganic fibers herein refers to a mass formed solely of fibers, which may be shaped by using a binder, acid, heat, etc.

A composite plastic film which is obtained by sandwiching an aluminum vapor deposition film with a nylon film and a high-density polyethylene film may be used as the vapor deposition film. A composite plastic film which is obtained by sandwiching an aluminum foil with a nylon film and a high-density polyethylene film may be used as the metal thin film.

The vapor deposition film has a flat sealing surface, on which the vapor deposition film is affixed to the metal thin film. On the other hand, the metal thin film has a non-flat sealing surface, on which the metal thin film is affixed to the vapor deposition film. The outer skin material thus formed is disposed such that the vapor deposition film is in contact with the outer casing 124 or the inner casing 125.

The packaging material 133 having gas barrier capability is made ready for use in the following manner: the gas adsorbent is placed inside the packaging material 133 and a sealing material is disposed at an opening of the packaging material 133. A container formed of an inexpensive material such as aluminum, steel, copper, or stainless steel is readily available as the packaging material 133. In the present embodiment, an aluminum container is used as the packaging material 133, and a glass composite is used as the sealing material. The reason for this is as follows: the thermal expansion coefficient of aluminum is great among various metals; and the degree of contraction of aluminum is significantly greater than that of the glass composite in heating and cooling processes at the time of vacuum-sealing the inside of the outer skin material 135, and therefore, aluminum exerts a physical stress to sandwich the glass composite, which allows the glass composite to more firmly seal the metal container.

Since aluminum is more flexible than other metals, when aluminum contracts and sandwiches the glass composite, the aluminum stretches so as to be able to sandwich the glass composite with a suitable stress without destroying the glass composite. Accordingly, in a case where, after the decompression sealing, the metal packaging material 133 is opened so as to allow the gas adsorbent to exert its function, the metal packaging material 133 can be readily opened owing to the flexibility of the aluminum.

The gas adsorbent 137 is an adsorbent capable of adsorbing non-condensable gas that is contained in gas. For example, an alkaline metal oxide, an alkaline-earth metal oxide, an alkaline metal hydroxide, or an alkaline-earth metal hydroxide can be used as the gas adsorbent 137. Examples of the gas adsorbent 137 include lithium oxides, lithium hydroxides, barium oxides, and barium hydroxides. With use of such an adsorbent, nitrogen which accounts for approximately 75% of air can be adsorbed at normal temperatures, which makes it possible to obtain a high degree of vacuum.

The destruction portion 134 also serves as the sealing material, and is formed of a glass composite that is more fragile and destructible than the packaging material 133. That is, the destruction portion 134 functions as a sealing portion for sealing the gas adsorbent within the packaging material 133, and since the destruction portion 134 is formed of a fragile and destructible material, a through-hole can be assuredly formed in the packaging material 133 after the decompression sealing, and thus the destruction portion 134 functions as both a sealing portion and a destruction portion.

The outer skin material 135 having gas barrier capability wraps around the core material 132, the packaging material 133, the gas adsorbent 137, and the destruction portion 134, thereby separating these components from the surrounding space. The gas permeability of the outer skin material 135 is preferably equal to or less than $10^4$ [$cm^3/m^2 \cdot day \cdot atm$], and more desirably equal to or less than $10^3$ [$cm^3/m^2 \cdot day \cdot atm$].

Although in the present embodiment the destruction portion 134, which is formed at the edge of the packaging material 133 to also serve as a sealing portion, is used in the method of opening the hole, any member capable of causing the packaging material 133 to be destroyed by means of external force after the outer skin material 135 is vacuum-sealed may serve as the destruction portion 134. For example, a low-rigidity portion, or a sealed portion, of the packaging material 133 may serve as the destruction portion to be destroyed.

Figure 5:
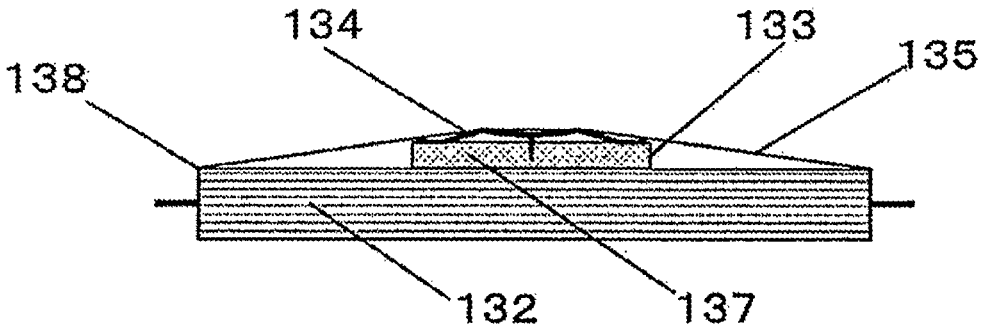
FIG. 5 is a cross-sectional view of a second vacuum heat insulating material, to which the gas adsorbent according to Embodiment 1 of the present invention is applied.

As an alternative method, a protrusion may be caused to come into contact with the packaging material 133 to form a hole. FIG. 5 shows another vacuum heat insulating material 138 using a gas adsorbent 137. The vacuum heat insulating material 138 is formed in the following manner: a core material 132 including at least a fibrous material, and a gas adsorbent 137 vacuum-packed in a pouch formed of a packaging material 133 having gas barrier capability, are covered with an outer skin material 135 having gas barrier capability; then the outer skin material 135 is vacuum-sealed; and thereafter a hole is formed in the packaging material 133, so that the inside of the packaging material and the inside of the outer skin material are caused to be in communication with each other.

As mentioned above, in the vacuum heat insulating material 138 shown in FIG. 5, a hole is formed in the packaging material 133 after the outer skin material 135 is vacuum-sealed. In the present embodiment, a member 134 having a protrusion adjacent to the packaging material 133 is placed inside the outer skin material 135 in advance, and after the outer skin material 135 is vacuum-sealed, external force is applied onto the member 134 having the protrusion, so that a hole is formed in the packaging material 133.

It should be noted that, as compared to the thermal conductivity of a vacuum heat insulating material that is fabricated by using a core material formed solely of a powdery material, the thermal conductivity of a vacuum heat insulating material that is fabricated by using a core material including a fibrous material is low in a low-pressure region and high in a high-pressure region. Therefore, for a vacuum heat insulating material that is fabricated by using a core material including a fibrous material, it is important to keep the pressure inside the outer skin material low.

It should be noted that since the vacuum heat insulating material 138 used in the present embodiment, in which the gas adsorbent 137 is used, includes the gas adsorbent 137 in the outer skin material, the pressure inside the outer skin material is kept low, and the thermal conductivity of the vacuum heat insulating material using the core material 132 including a fibrous material is kept low. Since the pressure inside the outer skin material is kept low, the rigidity of the vacuum heat insulating material is high.

Generally speaking, the thermal conductivity of the vacuum heat insulating material is determined by the sum of thermal conduction by the core material and thermal conduction by residual gas in the outer skin material. For example, in a case where the core material contains powder, the mean free path of gas existing inside the core material is short. Accordingly, thermal conduction by the gas is very small and thermal conduction by the core material is dominant. On the other hand, in a case where the core material is fibrous, contact between the fibers is small, and therefore, the thermal conductivity of the core material is very low. However, the mean free path of gas existing inside the core material is long. Accordingly, even a slight pressure increase causes the thermal conduction by the gas to be dominant. Such effect is significant in a case where the core material is formed solely of fibers. Therefore, in such a case, keeping the pressure inside the outer skin material low is very effective for reducing the thermal conductivity of the vacuum heat insulating material.

Hereinafter, operations and functions of the refrigerator configured as above are described.

As in the present embodiment, a common refrigerator compartment layout is such that the vegetable compartment 106 is disposed at the lower part of the refrigerator; the freezer compartment 105 is disposed at the middle part of the refrigerator; and the refrigerator compartment 102 is disposed at the upper part of the refrigerator. Such a layout is often used from the viewpoints of usability and energy saving. Also, a refrigerator with such a configuration that the compressor 117 is disposed at the back of the top surface is often used from the viewpoints of usability and increase in the volume of the refrigerator interior. In recent years, refrigerators with improved heat insulating performance and strength, aiming to achieve environmental friendliness from the viewpoint of energy saving, are available on the market. Such refrigerators suitably utilize and make the most of vacuum heat insulating materials having heat insulating performance that is several to ten times as great as the heat insulating performance of the rigid urethane foam 126.

In view of the above, in the present embodiment, each of the vacuum heat insulating materials 129 and 130 included in the side walls 101*a* includes the gas adsorbent 137 therein. Thus, since the vacuum heat insulating materials each including the gas adsorbent are included in the side walls which tend to become most distorted among the heat insulating walls, the rigidity of the side walls is improved and aging degradation of the vacuum heat insulating materials is suppressed. As a result, the rigidity of the heat-insulated box can be maintained for a long term.

As described above, deformed portions, which extend vertically straight, are formed in each of the vacuum heat insulating material 129 included in the left side wall 101*a* and the vacuum heat insulating material 130 included in the right side wall 101*a*. Owing to the vertically extending deformed portions, the rigidity of the side walls mainly when the side walls receive a vertical load can be improved. In this manner, the rigidity of the side walls in the vertical direction (longitudinal direction) is further increased. Thus, the deformed portions 130*a*, which extend vertically straight and which are formed in the vacuum heat insulating material included in the right side wall 101*a*, function as reinforcing portions of the right side wall 101*a* in the vertical direction. The same is true of the vacuum heat insulating material 129 included in the left side wall 101*a*.

Figure 6:
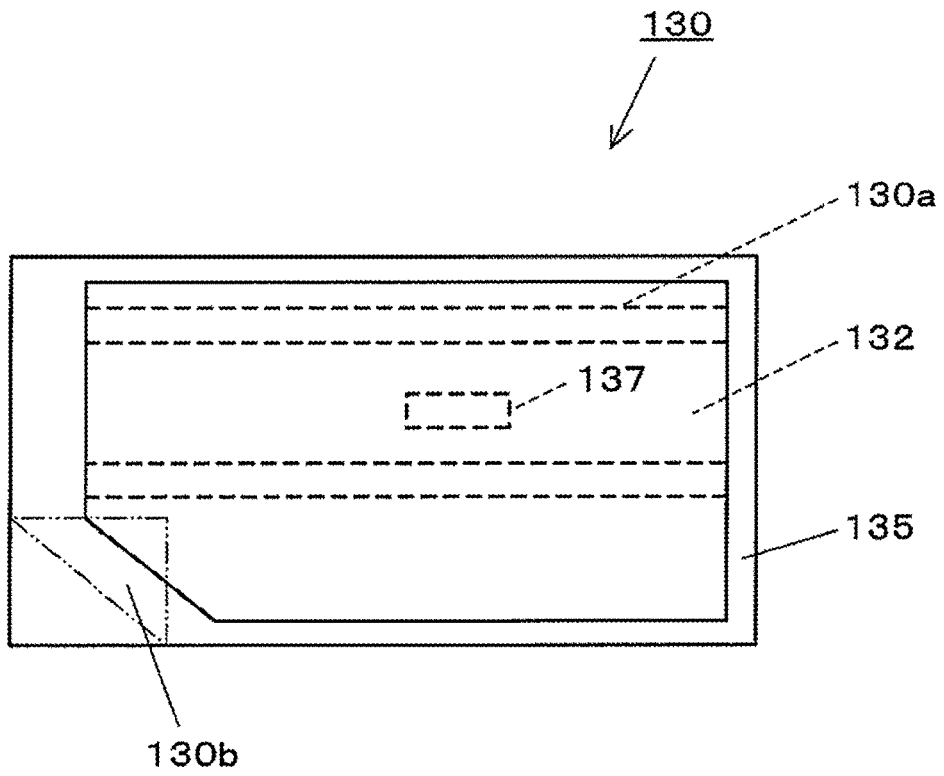
FIG. 6 is a plan view of a vacuum heat insulating material according to Embodiment 1 of the present invention.

FIG. 6 shows another structure applicable as the vacuum heat insulating material 130 of FIG. 3. As shown in FIG. 6, the core material 132 disposed in the vacuum heat insulating material 130 is rectangular. However, one of the four corners of the core material 132 is formed such that the one corner is notched away. Around the core material 132, a core-less portion is formed, which is formed solely of the outer skin material 135 not including the core material 132. In particular, at one of the four corners of the core material 132, the core-less portion that corresponds to the notched portion is folded back, and thereby the multi-layered portion 130*b* is formed. The deformed portions 130*a* indicated by dotted lines in the diagram are recesses in which the heat radiation piping 143 is embedded. The gas adsorbent 137 is disposed between two deformed portions 130*a* (i.e., between heat radiation pipes arranged side by side in the heat radiation piping 143) so as to be positioned away from the multi-layered portion 130*b*. In the example of FIG. 6, the gas adsorbent 137 is disposed inside the core material 132 near the center of the vacuum heat insulating material 130.

The multi-layered portion 130*b* formed solely of the outer skin material, the outer skin material having relatively high thermal conductivity in the vacuum heat insulating material, tends to exhibit a great temperature variation. However, by disposing the gas adsorbent at a position away from the multi-layered portion, a variation in the temperature of the gas adsorbent can be suppressed. For example, by suppressing an excessive increase in the temperature of the gas adsorbent, excessive activation and aging degradation of the adsorbent can be suppressed.

Further, the vacuum heat insulating materials each including the gas adsorbent, which are included in the left and right side walls, are both plate-shaped, and the area of a main surface of one vacuum heat insulating material and the area of a main surface of the other vacuum heat insulating material are the same. Accordingly, the rigidity of the left side wall and the rigidity of the right side wall of the refrigerator can be made to be the same, which eliminates unbalanced rigidity in the heat-insulated box and makes it possible to form a well-balanced heat-insulated box with stable strength.

The refrigerator according to the present embodiment includes the aforementioned swing door 102*a* for the refrigerator compartment 102, which is connected to the body 101 via the upper hinge holder 102*b*. In the case of the door 102*a* connected in such a manner, generally speaking, when the door 102*a* is in an opened state, a great load is imposed on a side wall, which tends to cause deformation and inclination of the side wall. However, in the present embodiment, the highly rigid vacuum heat insulating materials each including the gas adsorbent are included in the side walls. Therefore, even if the door 102*a* is in an opened state, deformation of a side wall causing, for example, an inclination of the side wall can be suppressed, and deformation of the entire heat-insulated box can be prevented.

In the vacuum heat insulating material 138 according to the present embodiment, the gas adsorbent 137 is, when seen in the thickness direction of the vacuum heat insulating material, disposed closer to the interior of the refrigerator (i.e., closer to the inner casing). This lowers a possibility of the gas adsorbent 137 coming into contact with air. Accordingly, even if the refrigerator is used for a long term, the gas adsorbent 137 can continuously adsorb air that enters the vacuum heat insulating material from the outside. Therefore, a certain degree of vacuum of the vacuum heat insulating material can be maintained for a long term, which makes it possible to prevent degradation in the thermal conductivity of the vacuum heat insulating material.

The present embodiment uses the gas adsorbent 137 capable of adsorbing, at normal temperatures, nitrogen which accounts for approximately 75% of air. This makes it possible to reduce residual air within the vacuum heat insulating material. Accordingly, as compared to the degree of vacuum of conventional vacuum heat insulating materials, the degree of vacuum of the vacuum heat insulating material according to the present embodiment is increased by adsorbing, at normal temperatures, nitrogen contained in a large amount in the residual air. Generally speaking, the atmospheric pressure is 100 KPa and the degree of vacuum of a vacuum heat insulating material is approximately 10 Pa. However, the degree of vacuum of the vacuum heat insulating material used in the present embodiment, in which the gas adsorbent 137 is used, is approximately 1 Pa. Thus, increase in the degree of vacuum of the vacuum heat insulating material is realized. As a result, improvement of the rigidity of the vacuum heat insulating material as well as reduction of the thermal conductivity of the vacuum heat insulating material can be realized.

The gas adsorbent 137 is capable of continuously adsorbing air entering through the outer skin material after the vacuum-sealing. This makes it possible to suppress aging degradation of the thermal conductivity of the vacuum heat insulating material, the aging degradation being caused when air has entered the vacuum heat insulating material due to elapse of time. Thus, high heat insulation capacity can be maintained for a long term.

Figure 7:
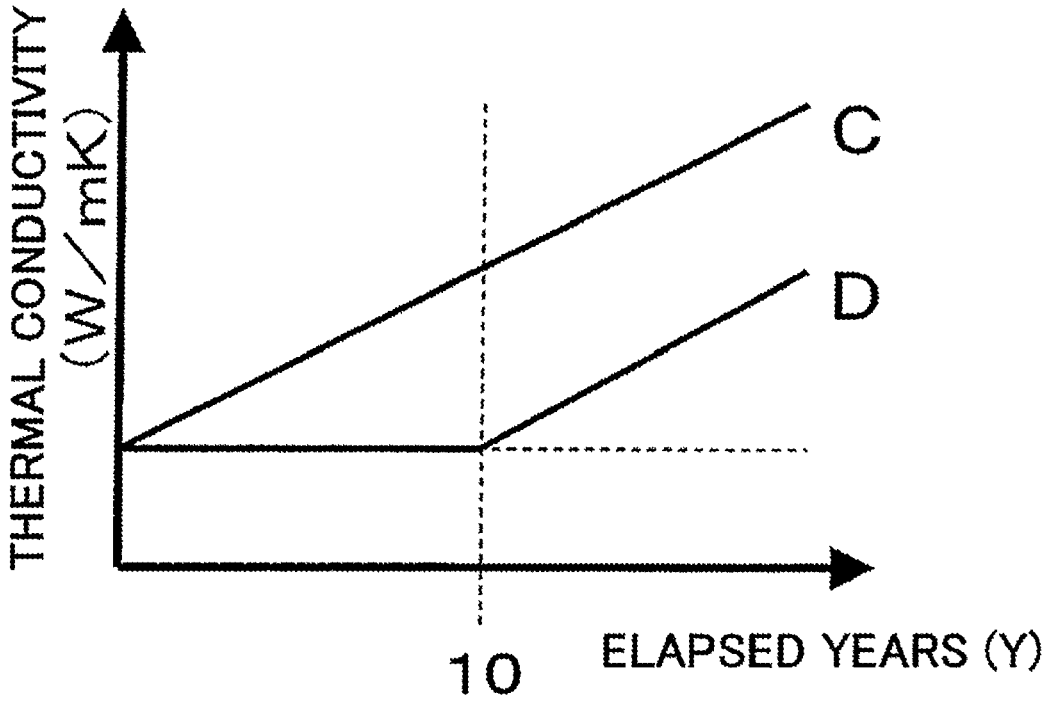
FIG. 7 shows aging degradation of a vacuum heat insulating material, to which the gas adsorbent according to Embodiment 1 of the present invention is applied.

FIG. 7 shows aging degradation of the thermal conductivity of the vacuum heat insulating material. As shown in FIG. 7, the thermal conductivity of a conventional vacuum heat insulating material (C) increases as years elapse after the start of usage since air enters the vacuum heat insulating material (C) as the time elapses. On the other hand, as compared to the conventional vacuum heat insulating material (C), the aging degradation of the thermal conductivity of a vacuum heat insulating material (D) in which the gas adsorbent 137 is used is suppressed since the gas adsorbent 137 adsorbs air that enters the vacuum heat insulating material (D) for a long term after the start of usage. As a result, high performance of the vacuum heat insulating material can be maintained for almost ten years. Thus, the initial performance of the vacuum heat insulating material can be maintained for a long term, which makes it possible to provide a refrigerator with excellent performance in terms of energy saving (low running cost).

The present embodiment takes the results shown in FIG. 7 into account, and chooses the amount of gas adsorbent 137 to be included for use on the assumption that the duration of use of the refrigerator by a user is approximately ten years. Specifically, the amount of single gas adsorbent to be included in the vacuum heat insulating material is set to approximately 0.5 g so that the initial performance of the vacuum heat insulating material can be maintained for at least ten years. It should be noted that the duration of use can be further extended by increasing the amount of gas adsorbent 137 to be included.

In the present embodiment, the vacuum heat insulating materials, in each of which the gas adsorbent 137 is used, are provided at their respective positions, and those having the greatest dimensions are the vacuum heat insulating materials (side insulating materials) 129 and 130 included in the side walls 101*a*. The dimensions of each of the vacuum heat insulating materials 129 and 130 are as follows: longitudinal dimension×lateral dimension×thickness dimension=510×

1505×10.5 mm. The volume of each of the vacuum heat insulating materials 129 and 130 is $8.06\times10^{-3}$ ($m^3$). In the present embodiment, the amount of gas adsorbent 137 to be included in each of the vacuum heat insulating materials 129 and 130 is 60 $g/m^3$.

If the amount of gas adsorbent 137 is as above, then even in a large-area vacuum heat insulating material having a large area of contact with air, the gas adsorbent included in the vacuum heat insulating material continuously adsorbs air entering from the outside for ten years, which is an average duration of use of a refrigerator. Accordingly, a certain degree of vacuum of the vacuum heat insulating material can be maintained. As a result, degradation in the thermal conductivity of the vacuum heat insulating material can be prevented. Moreover, since the degree of vacuum of the vacuum heat insulating material is maintained, deformation of the vacuum heat insulating material due to entry of air can be prevented, which makes it possible to prevent external deformation of the outer casing of the refrigerator body.

It should be noted that if the amount of gas adsorbent is equal to or greater than 60 $g/m^3$, the air adsorption can be performed for a longer period of time than in the example of FIG. 7, and thus the period over which the degree of vacuum is maintained can be extended. Under the condition of a fixed amount of the gas adsorbent, if the area of the vacuum heat insulating material including the gas adsorbent is reduced, then the air adsorption can be performed for longer years, and thus the period over which the degree of vacuum is maintained can be extended.

The amount of gas adsorbent 137 affects the production cost of the vacuum heat insulating material. Therefore, a highly cost-effective vacuum heat insulating material can be provided by suitably choosing the amount of gas adsorbent 137 in accordance with the amount of residual air, which varies depending on the shape, dimensions, or volume of the vacuum heat insulating material to be used.

Figure 8:
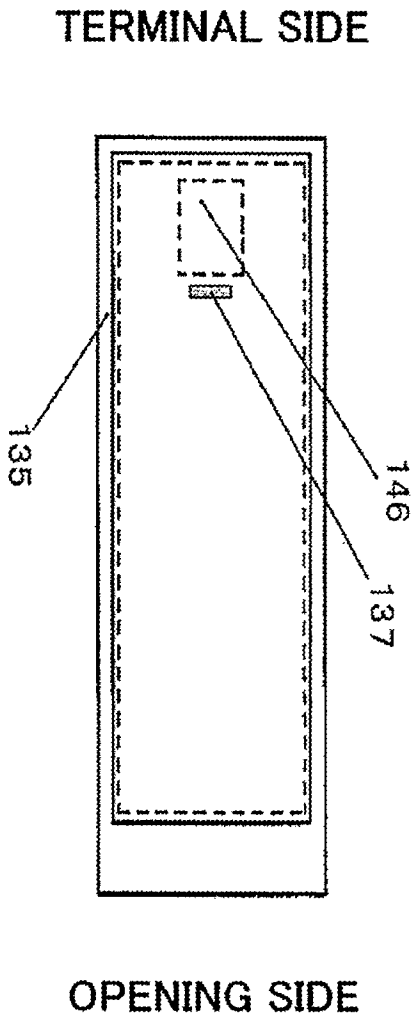
FIG. 8 shows placement of the gas adsorbent of the vacuum heat insulating material according to Embodiment 1 of the present invention.

FIG. 8 is one example of a vacuum heat insulating material usable in the refrigerator according to the present embodiment. In particular, FIG. 8 shows the placement of the gas adsorbent. As shown in FIG. 8, in the present embodiment, the gas adsorbent 137 included in the vacuum heat insulating material is disposed at a terminal position in the outer skin material 135. The terminal position is located at the opposite side to an opening through which vacuum drawing is performed. The reason for this is that the density of air within the outer skin material 135 of the vacuum heat insulating material becomes non-uniform in the process of producing the vacuum heat insulating material. Moreover, a reaction-type moisture adsorbent 146 serving to adsorb the internal moisture of the vacuum heat insulating material is disposed in the vacuum heat insulating material shown in FIG. 8.

After the production of the vacuum heat insulating material (i.e., after the vacuum-sealing), there is a possibility that the internal pressure of the vacuum heat insulating material increases due to moisture release from the core material. The aforementioned reaction-type moisture adsorbent 146 removes the moisture through adsorption. This makes it possible to greatly reduce a time necessary for drying (moisture removal), and to suppress heat insulating performance degradation caused by the internal pressure increase due to the moisture release. Thus, the productivity of the vacuum heat insulating material is not lowered.

For example, the vacuum heat insulating material is formed in the following manner: a sheet-shaped glass wool mass with a thickness of 5 mm is dried for one hour at 140° C.; thereafter, the glass wool mass is inserted in the outer skin material 135; and then the inside of the outer skin material 135 is subjected to vacuum drawing and an opening of the outer skin material 135 is sealed. In the process of producing the vacuum heat insulating material, three out of the four sides of the outer skin material 135 are sealed, so that the outer skin material 135 is formed into pouch-shaped. Then, a core material is placed inside the pouch-shaped outer skin material 135. Thereafter, through the opening of the unsealed side, the internal gas of the vacuum heat insulating material is removed and the inside of the vacuum heat insulating material is decompressed in an environment where the ambient pressure is lowered. Also, the opening is sealed. At the time, the overall internal pressure of the vacuum heat insulating material is relatively low. Such lowered pressure causes a change in the viscosity of air. As a result, the air density at the inlet (i.e., at the opening side in FIG. 8) of the outer skin material of the vacuum heat insulating material is different from the air density at the sealed terminal portion (i.e., at the terminal side in FIG. 8) of the outer skin material of the vacuum heat insulating material. Specifically, the density of air at the inlet of the outer skin material is low, and the density of air at the terminal portion of the outer skin material is high.

As shown in FIG. 8, the gas adsorbent 137 is disposed at a terminal position in the outer skin material 135. Therefore, residual air can be adsorbed effectively, which makes it possible to produce a vacuum heat insulating material with a higher degree of vacuum.

It should be noted that, with the effect of the gas adsorbent 137, the rigidity of the vacuum heat insulating material is improved and the thermal conductivity of the vacuum heat insulating material is reduced. The reason for this is that the degree of vacuum of the vacuum heat insulating material is increased with the use of the gas adsorbent 137. The degree of vacuum of the vacuum heat insulating material is determined by: the amount of gas entering the inside of the outer skin material of the vacuum heat insulating material from the outside; and the adsorption performance of the gas adsorbent 137. The degree of vacuum, rigidity, and thermal conductivity of the vacuum heat insulating material are correlated with each other. If the vacuum heat insulating material has a high degree of vacuum, then the rigidity thereof is high and the thermal conductivity thereof is low. In contrast, if the vacuum heat insulating material has a low degree of vacuum, then the rigidity thereof is low and the thermal conductivity thereof is high.

In the present embodiment, among the vacuum heat insulating materials affixed to the body 101 of the refrigerator, the vacuum heat insulating materials included in heat insulating walls having a large heat insulating material affixing area such as the side walls and the back wall include the gas adsorbent 137. The reason for this is as follows: a vacuum heat insulating material having a large area, which is expected to exert a high heat insulating effect, forms a main rigid wall that supports the body 101, and therefore, when the rigidity of such a large-area vacuum heat insulating material decreases due to aging degradation, it causes a significant influence.

Since these vacuum heat insulating materials included in heat insulating walls include the gas adsorbent 137, air that enters as years elapse during the use of the refrigerator can be adsorbed, which makes it possible to suppress performance degradation during the use of the refrigerator for approximately ten years.

Moreover, the vacuum heat insulating materials that have great dimensions and large area cover the refrigerator with high coverage. As a result, the degree of vacuum of the entire heat insulating walls of the refrigerator is increased. Consequently, not only is the rigidity increased, but also the thermal conductivity is reduced. Under the condition of the same vacuum heat insulating material thickness, if a vacuum heat insulating material in which the gas adsorbent is used as in the present embodiment is compared with a vacuum heat insulating material in which the gas adsorbent is not used, the vacuum heat insulating material in which the gas adsorbent is used realizes increased refrigerator interior volume and improved energy saving performance with reduced refrigerator wall thickness. In the present embodiment, the vacuum heat insulating materials 129 and 130 each having a thickness of approximately 8 to 11.5 mm and including the gas adsorbent 137 are used in the side walls; and the vacuum heat insulating material 128 having a thickness of approximately 15 mm and including the gas adsorbent 137 is used in the back wall. On the other hand, vacuum heat insulating materials having a thickness of approximately 8 to 15 mm and not including the gas adsorbent 137 are used as the vacuum heat insulating materials 127 and 131 at the top and the bottom. In this manner, the vacuum heat insulating material including the gas adsorbent is used at portions that highly contribute to the strength and energy saving performance of the refrigerator.

It should be noted that the temperature of the refrigerator is set to have two different temperature zones, that is, an above-zero refrigerating temperature zone approximately from 1° C. to 5° C. for storing fresh food and beverages, and a below-zero freezing temperature zone approximately not higher than −18° C. for storing frozen food. If the vacuum heat insulating material as described above is included in the side walls or the back wall of the refrigerator as in the present embodiment, the compartments 102 to 106 whose temperatures are set to fall within the aforementioned temperature zones can be widely covered by the vacuum heat insulating material. As a result, owing to the high heat insulation capacity of the vacuum heat insulating material, entry of heat from the outside can be widely suppressed. Consequently, a refrigerator box with excellent energy saving performance can be realized.

Including the most rigid vacuum heat insulating material (which has the highest degree of vacuum) in the side walls or the back wall means that the most rigid vacuum heat insulating material is included in portions that serve as the framework of the refrigerator body. As a result, the strength of the entire refrigerator can be improved and the wall thickness of the refrigerator can be reduced, which makes it possible to increase the interior volume of the refrigerator while maintaining the strength of the refrigerator.

Further, in the present embodiment, the gas adsorbent 137 is, in the vacuum heat insulating material, disposed closer to the interior of the refrigerator (i.e., closer to the inner casing). Therefore, even if, among surface portions of the vacuum heat insulating material, a portion where the gas adsorbent 137 is disposed protrudes from the other portions, the outer casing of the body 101 does not protrude, and thus external deformation of the outer casing can be prevented.

It should be noted that, in the present embodiment, the vacuum heat insulating material including the gas adsorbent 137 is affixed preferentially to a wall portion where the proportion of the wall thickness to an external dimension (e.g., width dimension) of the wall portion is less than or equal to 5%. Specific examples satisfying this condition are the vacuum heat insulating materials 128, 129, and 130 included in the side and back walls. For example, in the case of the side walls, the external width dimension of each side surface is 740 mm and the thickness of each side wall is 33 mm. In this case, the proportion of the wall thickness to the external width dimension is 33/740×100%=4.8%.

Generally speaking, the strength of a component member whose cross section is rectangular (second moment of area) is represented by the following bending stress formula: (cube of width)×height/12. When the formula is applied to a wall of the refrigerator, the width is the thickness of the wall of the refrigerator and the height is the height of the refrigerator (approximately 1800 mm). According to the above formula, the strength is proportional to the cube of the width. Therefore, the strength rapidly increases when the thickness reaches approximately 35 mm and becomes greater. In view of this, the present embodiment intends to mainly increase the strength of portions having the aforementioned proportion of approximately 5% or less, that is, portions having a wall thickness of approximately 35 mm or less.

It should be noted that under the condition that the external dimension is fixed, the strength increases in accordance with an increase in the proportion of the wall thickness to the external dimension, but the interior volume decreases in accordance with an increase in the proportion of the wall thickness to the external dimension. In the product development of a refrigerator, designs are developed with various external dimensions and layouts. In the stage of development, sufficient test data is collected and a design is made such that the proportion of the wall thickness to the external dimension becomes the most effective proportion in terms of the interior volume and strength. Such a design improves cost effectiveness.

It should be noted that in the refrigerator according to the present embodiment, heat insulating walls of the body 101 surrounding the freezer compartment 105 in the freezing area, the heat insulating walls being formed by using the rigid urethane foam 126 and the vacuum heat insulating materials 128, 129, and 130, have a thickness of 25 to 50 mm, except the refrigerator door but including thin wall portions around the opening. Also, heat insulating walls of the body 101 surrounding the refrigerator compartment 102 and the vegetable compartment 106 in the refrigerating area, the heat insulating walls being formed by using the rigid urethane foam 126 and the vacuum heat insulating materials 127 and 131, have a thickness of 25 to 40 mm, except the refrigerator doors but including thin wall portions around the openings.

In order to increase the interior volume, it is effective to reduce the thickness of the inner walls of the refrigerator. In general, however, reduction in the thickness of the inner walls hinders the fluidity of the rigid urethane foam, causing difficulty in the rigid urethane foam filling process. In this respect, since the vacuum heat insulating material including the gas adsorbent 137 has a thickness of approximately 8 to 11.5 mm, even after the vacuum heat insulating material is affixed to a heat insulating wall having a reduced thickness, the filling process of the rigid urethane foam 126 can be performed with no hindrance to the fluidity of the rigid urethane form 126. Moreover, since the vacuum heat insulating material including the gas adsorbent 137 has significantly reduced thermal conductivity, it is not necessary for a plurality of vacuum heat insulating materials to overlap each other to suppress the entry of heat. As a result, a partial size difference in the gap to be filled with the rigid urethane foam 126 does not arise (is suppressed), and also, deformation of the inner and outer surfaces as well as the occurrence of a void due to a decrease in the fluidity can be prevented.

It should be noted that, in the present embodiment, if the vacuum heat insulating materials including the gas adsorbent 137 included in the left and right side walls of the refrigerator have a thickness of 11.5 mm, then it is necessary for a vacuum heat insulating material that does not include the gas adsorbent 137 to have a thickness of 16 mm in order to obtain the same heat insulating performance as that of the vacuum heat insulating material including the gas adsorbent 137. Accordingly, under the condition of obtaining the same level of heat insulating performance, the use of the vacuum heat insulating materials including the gas adsorbent 137 allows the interior volume of the refrigerator to increase by 15 L as compared to a case where vacuum heat insulating materials that do not include the gas adsorbent 137 are used. Moreover, since the usage amount of rigid urethane foam 126 can be reduced, the cost and weight of a final product can be reduced. As a result of the weight reduction, the transportability of the product is improved.

In the present embodiment, a plurality of vacuum heat insulating materials whose degrees of vacuum and rigidities are varied from each other are suitably used, and thereby the strength of the body 101 of the refrigerator is improved. That is, expensive vacuum heat insulating materials including the gas adsorbent and inexpensive vacuum heat insulating materials not including the gas adsorbent are placed in a right-material-in-right-place manner in consideration of heat insulation capacity and rigidity required at each portion of the refrigerator as well as costs. In particular, among the plurality of vacuum heat insulating materials, high-rigidity vacuum heat insulating materials are included in the refrigerator's side walls and back wall which cover the refrigerator with high coverage. In this manner, the strength of the body 101 can be improved.

This is the same as increasing the entire strength of an ordinary chest of drawers or housing walls by increasing the strength of their vertical surfaces (side surfaces and back surface). A vacuum heat insulating material including the gas adsorbent and having high rigidity is used at portions that contribute to the strength of the refrigerator, and a vacuum heat insulating material not including the gas adsorbent and having higher rigidity than the rigid urethane foam 126 is used at portions that do not greatly contribute to the strength of the refrigerator. In this manner, a refrigerator with increased body strength, improved heat insulating performance, and improved energy saving performance can be provided. In particular, a vacuum heat insulating material having high rigidity is used at portions having a thin wall, and a vacuum heat insulating material having relatively low rigidity but being more rigid than the rigid urethane foam 126 is used at portions having a thick wall. In this manner, well-balanced box strength is obtained and the strength of the entire box can be maintained. The thickness of each vacuum heat insulating material is approximately 8 to 15 mm. Each vacuum heat insulating material has higher rigidity and lower thermal conductivity than the rigid urethane foam 126 under the condition that the thickness of the vacuum heat insulating material is the same as that of the rigid urethane foam 126.

It should be noted that although various combinations of conventional vacuum heat insulating materials and the vacuum heat insulating material 138 using the gas adsorbent 137 are conceivable for realizing required performance (such as dimensions and heat insulating performance) of the refrigerator, the costs vary for each combination. Therefore, the dimensions, thickness, and type (i.e., whether the gas adsorbent is necessary) of each vacuum heat insulating material may be determined in consideration of required performance and costs including material costs of the refrigerator.

The area (of a main surface) of the vacuum heat insulating material 131 disposed in contact with the bottom surface of the inner casing 125 is, when seen in the thickness direction of the vacuum heat insulating material 131, less than the area of the inner casing 125. In other words, the vacuum heat insulating material 131 disposed in contact with the inner casing 125 is not in a state of spreading out of the inner casing with which the vacuum heat insulating material 131 is in contact. Thus, the vacuum heat insulating material 131 is in a state where one of its main surfaces (i.e., a bonded surface) is entirely in contact with the bottom surface of the inner casing 125.

Accordingly, in the refrigerator according to the present embodiment, when the rigid urethane foam 126 is flowed in between the outer casing 124 and the inner casing 125 after the vacuum heat insulating material 131 is disposed at its predetermined position, force in such a direction as to peel off the vacuum heat insulating material 131 from the inner casing 125 is not applied to the vacuum heat insulating material 131 disposed in contact with the inner casing 125. Accordingly, the vacuum heat insulating material 131 is prevented from being peeled off due to the inflow of the rigid urethane foam 126. Moreover, the vacuum heat insulating material 131 can be readily and stably affixed in a manner not to hinder the fluidity of the rigid urethane foam 126. Consequently, entry or remaining of inert gas such as air between the vacuum heat insulating material 131 and the inner casing 125 can be suppressed. As a result, the inner casing 125 and the vacuum heat insulating material 131 are closely in contact with each other, which advantageously suppresses an occurrence of deformation such as a recess formed in the inner casing.

Since the vacuum heat insulating material 127 at the top is disposed in contact with the outer casing 124, fittings or electrical wires for the lighting of the refrigerator's interior can be attached to the ceiling surface of the inner casing 125. Accordingly, lighting can be attached to the ceiling surface of the refrigerator compartment 102, and thereby usability can be improved.

It should be noted that, in the present embodiment, the vacuum heat insulating material at the bottom of the refrigerator body is disposed such that the plane of projection of a U-shaped bottom reinforcing member 144 overlaps the plane of projection of the vacuum heat insulating material. As a result, the strength of the base of the refrigerator body 101 is improved, which further improves the strength of the entire body 101. A highly rigid material such iron or stainless steel can be used as the bottom reinforcing member 144. It is desirable that the surface of the bottom reinforcing member 144 is anti-rust treated so that the bottom reinforcing member 144 will not rust due to the moisture of external air. In the present embodiment, the bottom reinforcing member 144 is U-shaped. However, for example, an L-shaped bottom reinforcing member may be used instead, so long as it is determined from the viewpoint of cost reduction and results of body strength measurement that the L-shaped member can be suitably used to obtain required strength.

Embodiment 2

Figure 9:
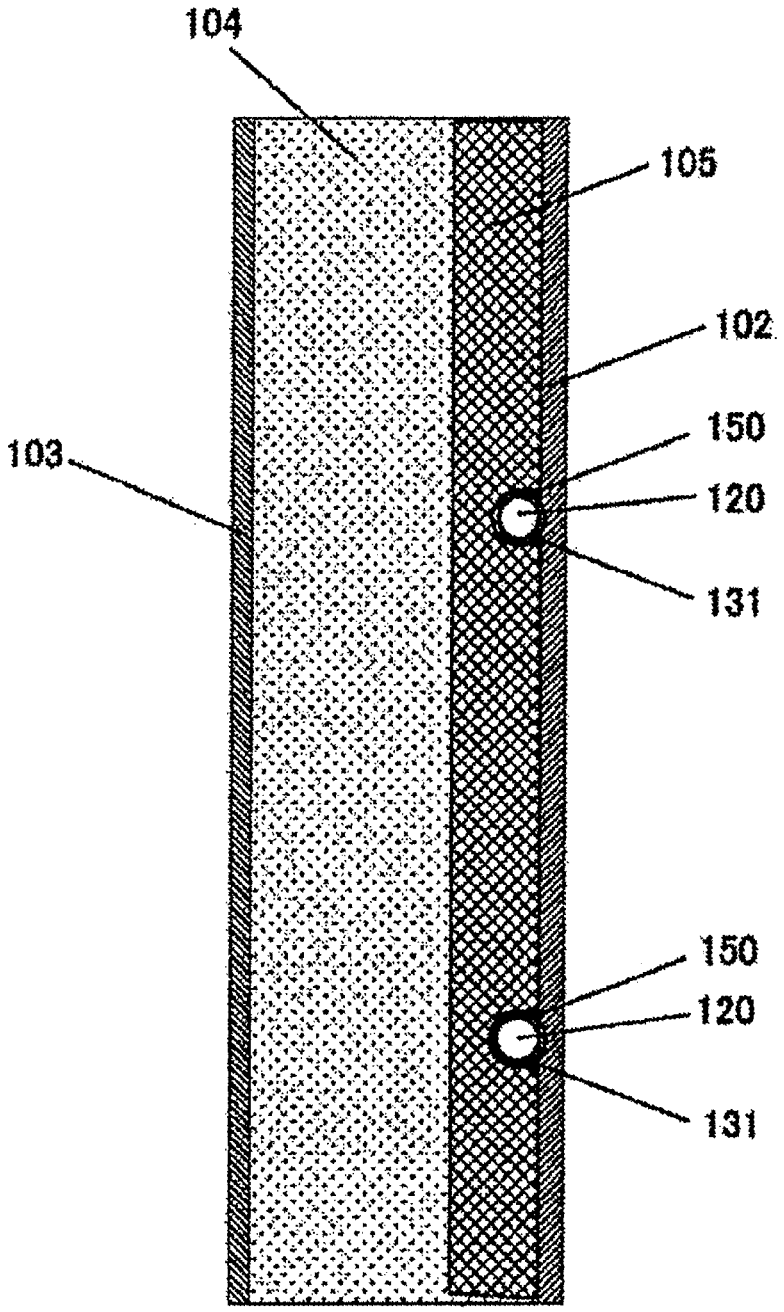
FIG. 9 is a side cross-sectional view of a refrigerator that serves as a comparative example in Embodiment 2 of the present invention.
Figure 10:
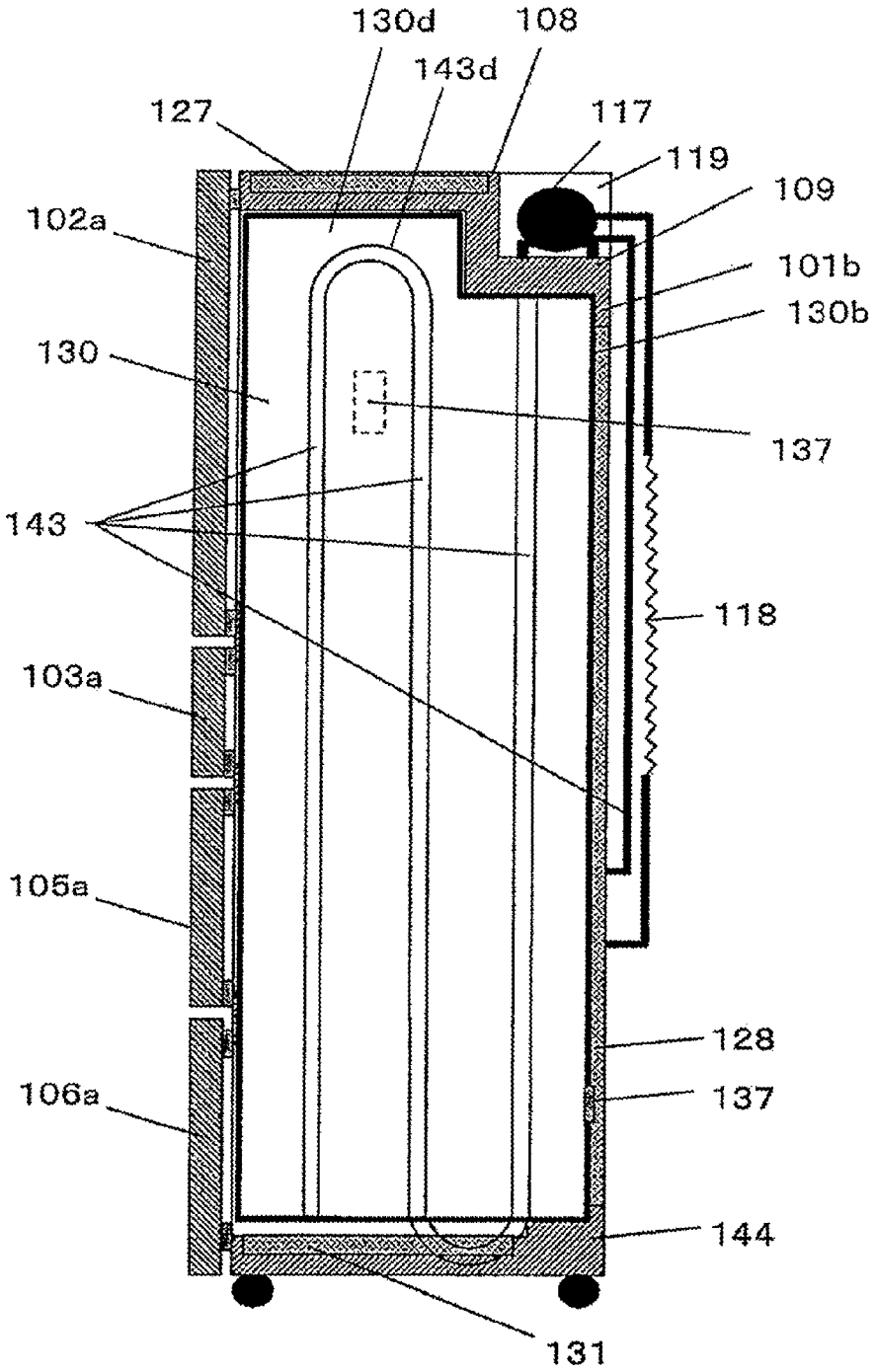
FIG. 10 is a longitudinal sectional view of a side wall of a refrigerator according to Embodiment 2 of the present invention.
Figure 11:
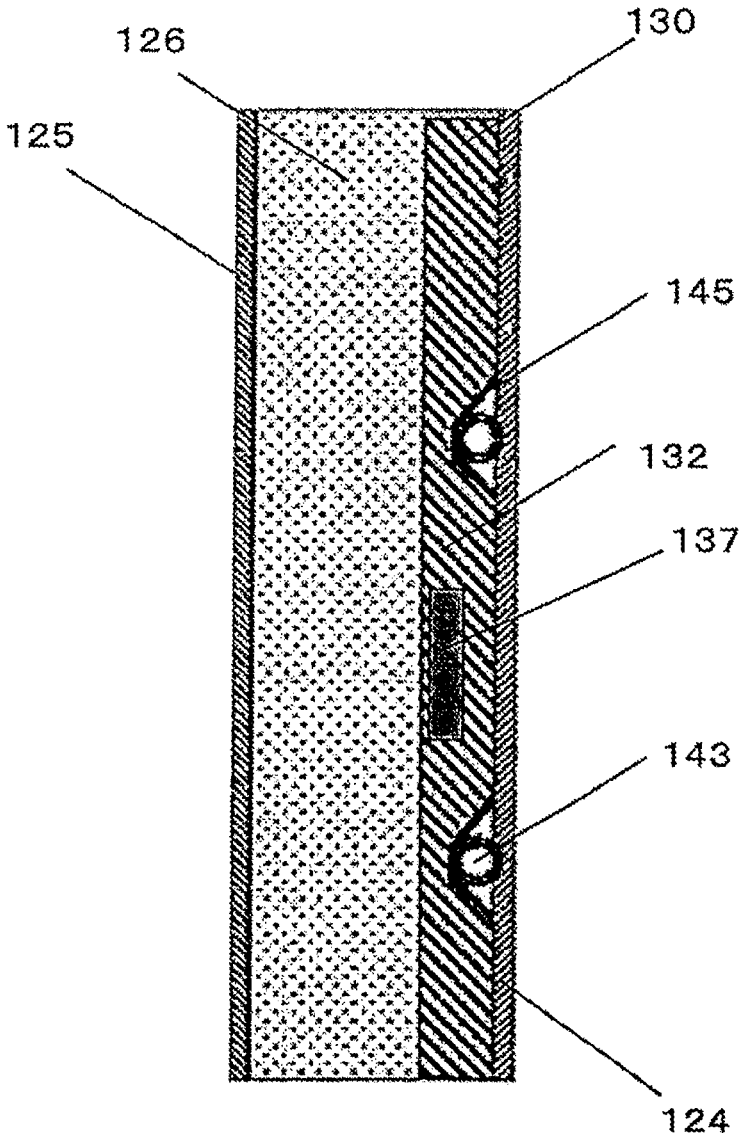
FIG. 11 is a side cross-sectional view of the refrigerator according to Embodiment 2 of the present invention.

Hereinafter, Embodiment 2 of the present invention is described with reference to the drawings. It should be noted that, in Embodiment 2, the same configurations as those of Embodiment 1 are denoted by the same reference signs as those used in Embodiment 1, and a detailed description of such configurations is omitted. FIG. 9 is a side cross-sectional view of a refrigerator that serves as a comparative example in Embodiment 2. FIG. 10 is a longitudinal sectional view of a side wall of a refrigerator according to Embodiment 2. FIG. 11 is a side cross-sectional view of the refrigerator according to Embodiment 2.

First, the refrigerator of the comparative example in Embodiment 2 is described. In recent years, refrigerators with improved heat insulating performance and strength aiming at energy saving as an environmental effort are on the market. Such refrigerators suitably utilize and make the most of vacuum heat insulating materials having heat insulating performance that is several to ten times as high as the heat insulating performance of the rigid urethane foam 126.

FIG. 9 is a cross-sectional view of a heat insulating wall of a refrigerator disclosed in Japanese Laid-Open Patent Application Publication No. 2007-198622. The heat insulating wall includes: an outer casing 102; an inner casing 103; and a urethane heat insulating material 104 serving to fill space between the inner casing 103 and the outer casing 102. The heat insulating wall further includes: a vacuum heat insulating material 105 provided between the outer casing 102 and the inner casing 103 so as to be closely in contact with the outer casing 102; and heat radiation piping 120 formed between the vacuum heat insulating material 105 and the outer casing 102. The heat radiation piping 120 is embedded in the surface of the vacuum heat insulating material 105.

However, the refrigerator of the above comparative example is configured such that although the vacuum heat insulating material and rigid urethane foam exist between the outer casing and the inner casing, the vacuum heat insulating material has a large air-contacting area. Accordingly, as years elapse during the use of the refrigerator, air tends to enter the inside of the vacuum heat insulating material. Since the degree of vacuum of the inside of the vacuum heat insulating material decreases if air enters the vacuum heat insulating material, there is a risk that degradation in thermal conductivity is caused. Moreover, there is a problem in that external deformation such as a recess occurs to the refrigerator when air enters the vacuum heat insulating material in which the degree of vacuum has decreased over time during its long-term use.

A more detailed description is given hereinafter. The refrigerator is configured such that the heat radiation piping is disposed at the outer casing of the refrigerator, and the vacuum heat insulating material is affixed in a manner to cover the heat radiation piping. Here, the vacuum heat insulating material is covered by the rigid urethane foam. However, since the heat radiation piping extends to the outside of the rigid urethane foam and an air layer is formed when the heat radiation piping is taped to the outer casing by aluminum tape, the vacuum heat insulating material directly contacts the external air or indirectly contacts the external air via the rigid urethane foam and aluminum tape.

In view of the above, in the refrigerator according to the present embodiment, the gas adsorbent included in the vacuum heat insulating material is disposed away from heat generating portions of the refrigerator. In the present embodiment, the heat generating portions refer to the compressor 117 and the heat radiation piping 143, for example (see FIG. 10).

Hereinafter, the refrigerator according to Embodiment 2 is described with reference to FIG. 10 and FIG. 11. It should be noted that FIG. 2 previously described in Embodiment 1 is also referred to in the description below as a front cross-sectional view of the refrigerator.

As shown in FIG. 2, the vacuum heat insulating materials 127, 128, 129, and, 130 are in contact with and affixed to the inside of the top, back, left side, and right side surfaces of the outer casing 124, respectively. The vacuum heat insulating material 131 is in contact with and affixed to the bottom surface of the inner casing 125.

Each of the vacuum heat insulating materials 128, 129 and 130 includes therein the gas adsorbent 137 which is disposed closer to the interior of the refrigerator (i.e., closer to the inner casing) than the central position in the vacuum heat insulating material.

The heat radiation piping 143 is disposed in the vacuum heat insulating materials 128, 129, and 130 at the outer casing 124 side. As shown in FIG. 10, the heat radiation piping 143 is disposed in a serpentine manner along the surface of the vacuum heat insulating material 130 included in the right side wall of the refrigerator. To be more specific, the heat radiation piping 143 is formed in the following manner: one end of a U-shaped pipe is connected to one end of a vertically disposed straight pipe; and one end of another vertically disposed straight pipe is connected to the other end of the U-shaped pipe. In such a manner, straight pipes and U-shaped pipes are sequentially connected to form the heat radiation piping 143. It should be noted that the above description and the description below regarding the right side wall similarly apply to the structure of the left-side heat insulating wall and to the structure and arrangement of heat radiation piping provided along the left side wall.

In the present embodiment, as shown in FIG. 10 and FIG. 11, the vacuum heat insulating material 130 included in the right side wall of the refrigerator includes the gas adsorbent 137, and the core material 132 is interposed between the gas adsorbent 137 included in the vacuum heat insulating material 130 and the heat radiation piping 143 which is a heat generating portion. In the present embodiment, the vacuum heat insulating material 130 is disposed to cover the entire right side wall. The amount of core material 132 is reduced at an upper extension portion 130*d* of the vacuum heat insulating material 130, the extension portion 130*d* corresponding to a U-shaped bent portion 143*d* of the heat radiation piping 143. The gas adsorbent 137 is not disposed inside the core material 132 of the extension portion 130*d*. In this manner, the thickness of the extension portion 130*d* of the vacuum heat insulating material 130 is reduced compared to the thickness of the other portions of the vacuum heat insulating material 130.

Thus, as shown in FIG. 10, the vacuum heat insulating material 130 according to the present embodiment is such that the gas adsorbent 137 and the heat radiation piping 143 are arranged with a certain distance therebetween. Moreover, since the core material 132, which is a heat insulating material, is interposed between the gas adsorbent 137 and the heat radiation piping 143, heat from the heat radiation piping 143 that reaches the gas adsorbent is reduced.

As shown in FIG. 11, the gas adsorbent 137 is, when seen in the thickness direction of the vacuum heat insulating material 130, disposed at such a position as not to overlap the heat radiation piping 143 which is a heat generating portion, and not to overlap the compressor 117.

With the above configuration, the temperature of the gas adsorbent included in the vacuum heat insulating material is prevented from becoming a high temperature, so that the gas adsorbent is prevented from becoming highly activated in a short term, and thus the gas adsorbent is allowed to exert its function for a long term. Further, aging degradation of the outer skin material around the gas adsorbent is prevented, and thereby influence on the gas adsorbent due to its contact with air can be reduced. As a result, even in a case where the heat-insulated box is used for a long term, the gas adsorbent included in the vacuum heat insulating material is able to continuously adsorb air that enters from the outside. This makes it possible to maintain the degree of vacuum of the vacuum heat insulating material, and to suppress degradation in the thermal conductivity of the vacuum heat insulating material.

Moreover, in a case where the gas adsorbent 137 is accommodated in a packaging material 133 formed as a metal container, if the container is positioned near a high temperature portion, then the metal packaging material 133 having high thermal conductivity becomes a heat spot. Accordingly, the temperature of the container is always kept high, causing the gas adsorbent in the container to be highly activated. As a result, there is a possibility that the adsorption performance decreases in a short term. In view of this, in the present embodiment, the gas adsorbent and the heat generating portion are spaced apart from each other, which allows the gas adsorbent to exert its function for a long term.

In a case where a vapor deposition film is used as the outer skin material of the vacuum heat insulating material, the degradation of the outer skin material is accelerated by temperature increase. Therefore, in this case, there is a risk that the amount of air entry increases as a result of the outer skin material degrading over time during long-term use. Therefore, as in the present embodiment, the gas adsorbent and the heat generating portion may be spaced apart from each other to prevent the temperature of the gas adsorbent and its surroundings from becoming a high temperature. In such a manner, an occurrence of the following situation can be suppressed: the temperature of the outer skin material increases due to heat from the packaging material of the gas adsorbent; and thereby the outer skin material degrades.

The heat insulating wall shown in FIG. 11 includes the vacuum heat insulating material 130 including the gas adsorbent 137. In the vacuum heat insulating material, the gas adsorbent 137 is disposed closer to the interior of the heat-insulated box (i.e., closer to the inner casing 125), and the heat radiation piping which is a heat generating portion is disposed closer to the outside of the heat-insulated box (i.e., closer to the outer casing 124).

In the above manner, the gas adsorbent and the heat generating portion can be assuredly spaced apart from each other, and the temperature of the gas adsorbent and its surroundings can be prevented from becoming a high temperature, which makes it possible to improve a long-term reliability of the vacuum heat insulating material.

Influence on the gas adsorbent 137 due to its contact with air is reduced since the gas adsorbent 137 is disposed inside the body 101. Therefore, even in a case where the heat-insulated box is used for a long term, the gas adsorbent 137 is able to continuously adsorb air that enters the vacuum heat insulating material from the outside. This makes it possible to maintain the degree of vacuum of the vacuum heat insulating material, and to prevent degradation in the thermal conductivity of the vacuum heat insulating material.

As shown in FIG. 11, the heat radiation piping 143 is disposed inside the outer casing 124 of the body 101 of the heat-insulated box, and is fixed by aluminum tape 145. The aluminum tape 145 is disposed so as to extend to the outside from an inside portion that is demarcated by the outer casing 124 and the inner casing 125, the inside portion being filled with the rigid urethane foam 126. That is, space inside the aluminum tape 145 is in communication with the outside. The reason for this is as follows: in the process of producing the refrigerator, heat generated when the rigid urethane foam 126 is foamed causes air inside the aluminum tape 145 to expand, and resultant pressure may cause deformation of the outer casing 124; however, if the space inside the aluminum tape 145 is in communication with the outside, such deformation can be prevented.

Although the vacuum heat insulating material is disposed inside the rigid urethane foam 126, the vacuum heat insulating material directly contacts the external air or indirectly contacts the external air via the rigid urethane foam 126 and the aluminum tape 145 since the heat radiation piping 143 is disposed inside and outside the rigid urethane foam 126 and an air layer is formed by the aluminum tape 145 with which to tape the heat radiation piping 143 to the outer casing 124.

As a result, when the refrigerator is used for a long term, the vacuum heat insulating material which in no small part contacts air is affected over time by air that enters from the outside. Therefore, in a case where the vacuum heat insulating material does not include the gas adsorbent 137, the degree of vacuum of the inside of the vacuum heat insulating material decreases at an early stage and the vacuum heat insulating material expands, which may cause external deformation of the outer casing 124 of the refrigerator.

As described above, the gas adsorbent 137 in the vacuum heat insulating material is disposed at a position away from heat generating portions such as the compressor 117 and the heat radiation piping 143. As a result, the metal container for the gas adsorbent 137 is suppressed from absorbing heat from the heat generating portions, and an occurrence of the following situation is prevented: a local portion that cannot be insulated (i.e., a heat spot) occurs in the vacuum heat insulating material; and thereby heat radiation performance (performance of heat radiation from the heat radiation piping to the outside of the refrigerator) decreases.

In particular, in a case where at least two heat radiation pipes are embedded in the surface of the vacuum heat insulating material of the refrigerator, it is desirable that the gas adsorbent be embedded between the two heat radiation pipes. In the present embodiment, as shown in FIG. 10, the straight and U-shaped pipes are continuously connected to form the heat radiation piping 143. In this case, it is preferred that the gas adsorbent 137 be embedded between two straight heat radiation pipes included in the heat radiation piping 143, such that the gas adsorbent 137 is away from both the straight heat radiation pipes by the same distance. In this manner, heat radiation performance and energy saving performance can be improved.

The manner of producing the gas adsorbent 137 used in the present embodiment may be the same as the manner of producing the gas adsorbent 137 described in Embodiment 1, and the structure of the gas adsorbent 137 used in the present embodiment may be the same as the structure of the gas adsorbent 137 described in Embodiment 1. Accordingly, the gas adsorbent 137 used in the present embodiment is capable of adsorbing, at normal temperatures, nitrogen which accounts for approximately 75% of air. This makes it possible to reduce residual air inside the vacuum heat insulating material, increase the degree of vacuum and rigidity of the vacuum heat insulating material, and reduce the thermal conductivity of the vacuum heat insulating material.

It should be noted that the temperature of the heat-insulated box is set to have two different temperature zones, that is, an above-zero refrigerating temperature zone approximately from 1° C. to 5° C. for storing fresh food and beverages, and a below-zero freezing temperature zone approximately not higher than −18° C. for storing frozen food. Therefore, in order to prevent the temperature of the gas adsorbent 137 from becoming excessively low and allow the gas adsorbent 137 to exert its adsorption function sufficiently at an early stage of its use, the gas adsorbent 137 in the vacuum heat insulating material may be disposed at a position that corresponds to the horizontal position of a compartment in the refrigerating temperature zone.

Although in the present embodiment the gas adsorbent 137 is disposed closer to the interior of the refrigerator (i.e., closer to the inner casing) than the central position in the vacuum heat insulating material, the gas adsorbent 137 may be alternatively disposed closer to the outside of the refrigerator (i.e., closer to the outer casing) than the central position in the vacuum heat insulating material. With such positioning, the activity of the gas adsorbent 137 is increased, and thereby the degree of vacuum of the vacuum heat insulating material can be further increased. As a result, the strength of the vacuum heat insulating material is increased and the thermal conductivity of the vacuum heat insulating material is reduced, which makes it possible to provide a refrigerator with high energy saving performance and exterior strength. The reason for this is that, at the outer casing side of the refrigerator body 101, the temperature of the gas adsorbent 137 increases due to the influence of heat from the external air and influence of heat from the heat radiation piping 143 which is taped to the inside of the outer casing.

Figure 12:
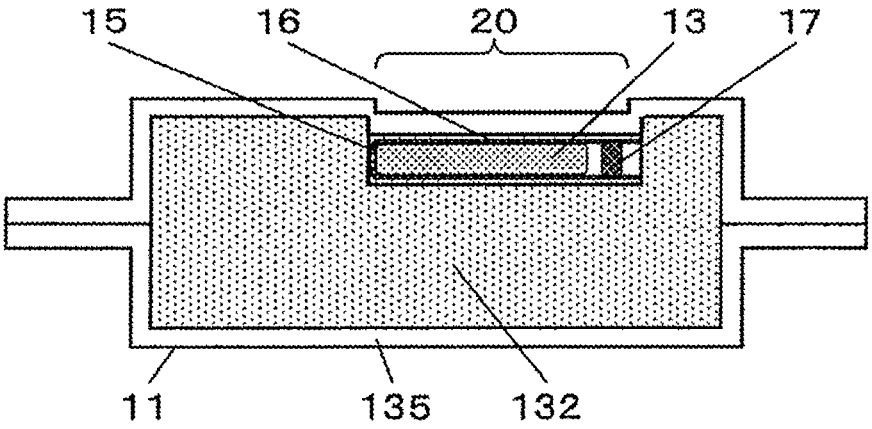
FIG. 12 is a cross-sectional view of a first vacuum heat insulating material according to Embodiment 2 of the present invention.

FIG. 12 is a cross-sectional view of a vacuum heat insulating material 11 in which the gas adsorbent is disposed closer to the outside of the refrigerator (i.e., closer to the outer casing) than the central position in the vacuum heat insulating material. The vacuum heat insulating material 11 is formed by covering the core material 132 and a gas adsorbing device 15 with the outer skin material 135. The gas adsorbing device 15 is embedded within the core material 132. The gas adsorbing device 15 and the core material 132 are included in the outer skin material 135, and are decompression-sealed. The gas adsorbing device 15 includes: a gas adsorbing material 13; a storage container 16 storing the gas adsorbing material 13; and a sealing material 17 sealing an opening of the storage container 16. The gas adsorbing device 15 is decompression-sealed. A recess 20 is formed in the outer skin material 135 of the vacuum heat insulating material 11 at the gas adsorbing device 15 side.

Accordingly, in a case where the storage container 16 is a metal container having high thermal conductivity, even if heat from the heat radiation piping 143 is directly transmitted to the gas adsorbing device 15 via the outer casing and the outer skin material and consequently the gas adsorbing device 15 of the vacuum heat insulating material 11 protrudes in the recess 20, external deformation of the outer casing of the refrigerator can be suppressed.

In a case where a metal packaging material having high thermal conductivity is used as in the present embodiment, heat from the heat radiation piping 143 is directly transmitted to the gas adsorbent 137 via the outer casing and the outer skin material. In order to reduce such transmission of heat, it is effective to include a heat insulating material between the gas adsorbent 137 and the outer skin material 135 or between the gas adsorbent 137 and the outer casing. For example, in a case where the gas adsorbent 137 is disposed closer to the outer casing in the thickness direction of the vacuum heat insulating material, it is effective to embed the gas adsorbent 137 in a heat insulating material (core material) so that the gas adsorbent 137 will not directly contact the outer skin material 135.

Figure 13:
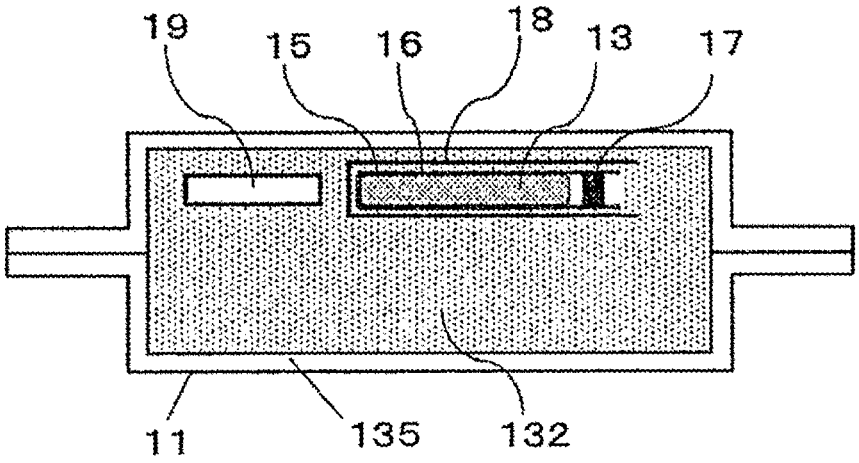
FIG. 13 is a cross-sectional view of a second vacuum heat insulating material according to Embodiment 2 of the present invention.

In this manner, the core material 132 included in the vacuum heat insulating material may be used as a heat insulating material, and the core material 132 may be disposed at the outer skin material 135 side of the gas adsorbent 137. FIG. 13 is a cross-sectional view of a vacuum heat insulating material in which the core material 132 is used as a heat insulating material. The vacuum heat insulating material 11 is formed by covering the core material 132, the gas adsorbing device 15, and a moisture adsorbent 19 with the outer skin material 135. Specifically, the gas adsorbing device 15 is included in an inner pouch 18. The inner pouch 18 is a movement restriction portion and has its three sides sealed. The gas adsorbing device 15 and the moisture absorbent 19 are embedded within the core material 132, and these components are included in the outer skin material 135 and decompression-sealed. The gas adsorbing device 15 includes: the gas adsorbing material 13; the storage container 16 storing the gas adsorbing material 13; and the sealing material 17 sealing the opening of the storage container 16. The gas adsorbing device 15 is decompression-sealed. In this manner, the gas adsorbent is embedded in the core material 132 such that the heat insulating material (core material) is interposed between the gas adsorbent and the outer skin material 135. This makes it possible to suppress conduction of heat to the gas adsorbent and conduction of heat from the gas adsorbent to the outer skin material.

Further, in the present embodiment, the vacuum heat insulating material 11 includes the core material 132 therein as described above. The core material 132 is formed of a mass of inorganic fibers such as glass wool fibers. The core material 132 is heated and dried; then inserted in the outer skin material 135 which is formed by affixing a vapor deposition film and a metal thin film together; and the inside of the outer skin material 135 is subjected to vacuum drawing and the opening thereof is sealed.

The vapor deposition film is a composite plastic film which is obtained by sandwiching an aluminum vapor deposition film with a nylon film and a high-density polyethylene film. The aluminum vapor deposition film advantageously has low thermal conductivity and is strong against bending. However, the gas barrier capability of the aluminum vapor deposition film is relatively low.

Meanwhile, the metal thin film is a composite plastic film which is obtained by sandwiching an aluminum foil with a nylon film and a high-density polyethylene film. The aluminum foil advantageously has high gas barrier capability. However, the thermal conductivity of the aluminum foil is high.

In view of the above, in the present embodiment, the vacuum heat insulating material 11 is disposed, such that the outer skin material 135 including the aluminum foil is positioned at the outer casing 124 side, and the outer skin material 135 including the aluminum vapor deposition film is positioned at the inner casing 125 side. Then, as shown in FIG. 12, the gas adsorbing device 15 is disposed near the outer skin material 135 including the aluminum foil. As a result, the high gas barrier capability of the aluminum foil suppresses entry of external air into the vacuum heat insulating material 11. In a case where the gas adsorbing device 15 is disposed in the above manner, the heat radiation piping is in proximity to the outer skin material 135 including the aluminum foil having high thermal conductivity. However, conduction of heat from the heat radiation piping to the gas adsorbing device 15 can be suppressed by disposing the gas adsorbing device 15 such that, when seen in the thickness direction of the vacuum heat insulating material, the gas adsorbing device 15 does not overlap the heat radiation piping. Moreover, the core material 132 is disposed in a manner to prevent direct contact between the aluminum foil and the metal storage container 16 storing the gas adsorbing material 13. This makes it possible to prevent the temperature of the gas adsorbing material from becoming a high temperature.

As an alternative mode, the vacuum heat insulating material may be disposed such that the outer skin material 135 including the aluminum vapor deposition film is positioned at the outer casing side, and the adsorbent may be included in the vacuum heat insulating material at a position near the outer skin material 135 including the aluminum vapor deposition film. As mentioned above, the aluminum vapor deposition film advantageously has low thermal conductivity. Therefore, the temperature of the adsorbent is suppressed from becoming a high temperature due to thermal conduction.

It should be noted that, in the present embodiment, the vacuum heat insulating material is affixed in a manner to cover the freezing temperature zone. As a result, portions and compartments whose temperature is greatly different from the temperature of external air or the temperature of other refrigerator compartments can be effectively insulated, and the performance of the vacuum heat insulating material can be well exploited.

Embodiment 3

Figure 14:
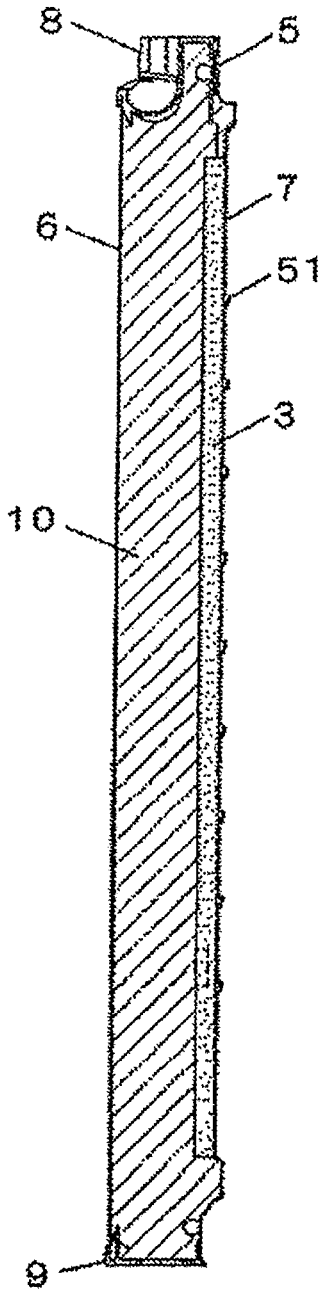
FIG. 14 is a side cross-sectional view of a door of a refrigerator that serves as a comparative example in Embodiment 3 of the present invention.
Figure 15:
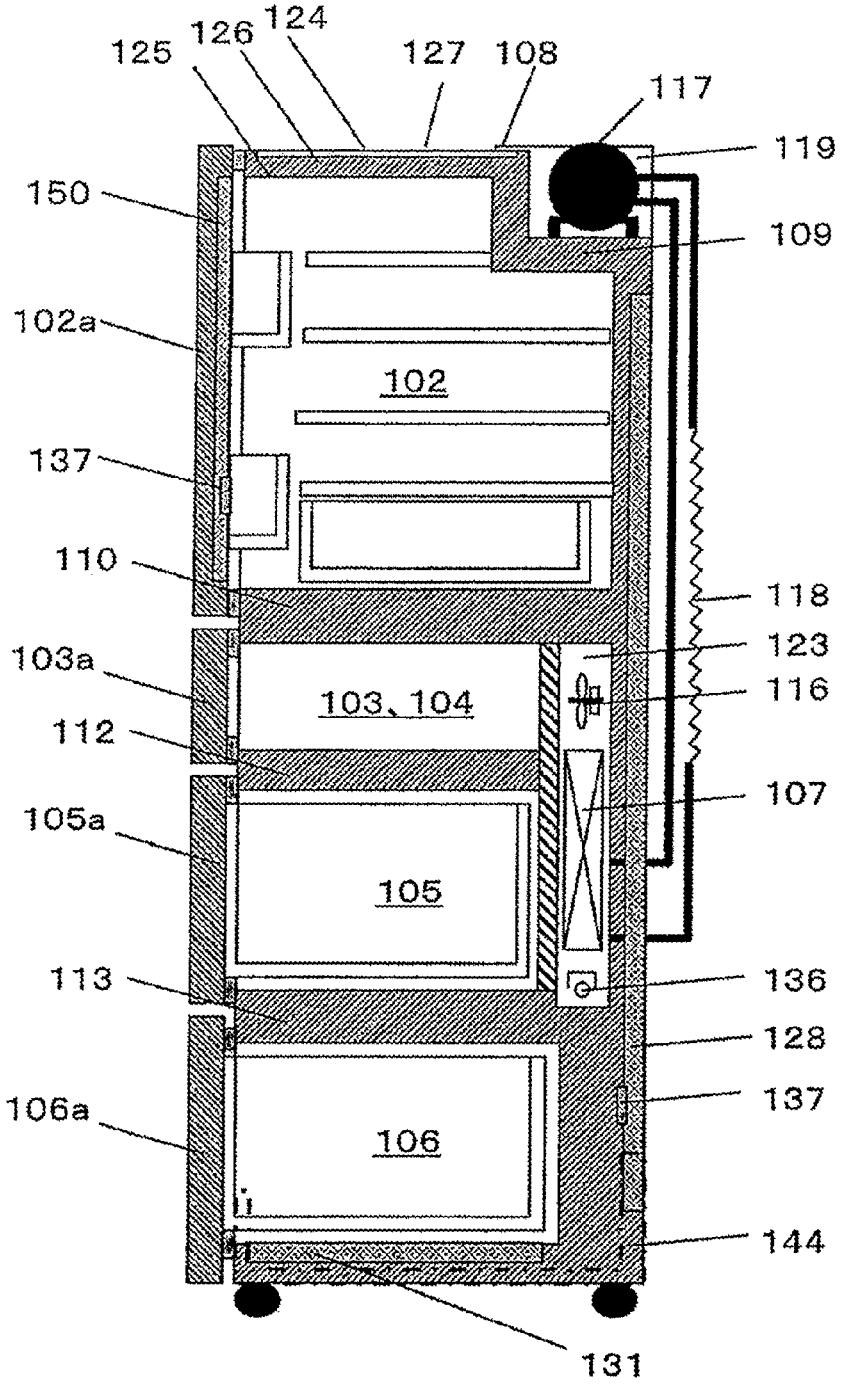
FIG. 15 is a longitudinal sectional view of a refrigerator according to Embodiment 3 of the present invention.
Figure 16:
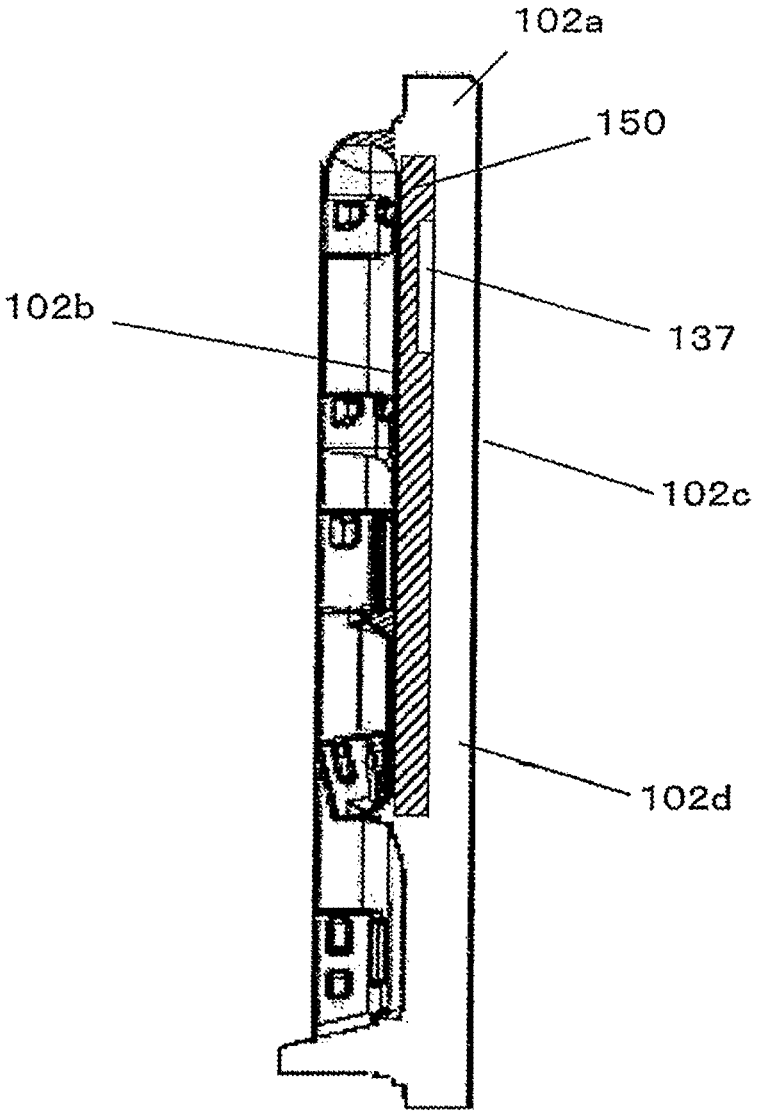
FIG. 16 is a longitudinal sectional view of a door of the refrigerator according to Embodiment 3 of the present invention.

Hereinafter, Embodiment 3 of the present invention is described with reference to the drawings. It should be noted that, in Embodiment 3, the same configurations as those of Embodiment 1 are denoted by the same reference signs as those used in Embodiment 1, and a detailed description of such configurations is omitted. FIG. 14 is a side cross-sectional view of a door of a refrigerator that serves as a comparative example in Embodiment 3. FIG. 15 is a longitudinal sectional view of a refrigerator according to Embodiment 3. FIG. 16 is a longitudinal sectional view of the door of the refrigerator according to Embodiment 3.

First, the refrigerator of the comparative example in Embodiment 3 is described.

FIG. 14 is a cross-sectional view of a door of a refrigerator disclosed in Japanese Laid-Open Patent Application Publication No. 2005-127602. A door body 5 is formed by filling, with urethane foam 10 which is a foamed heat insulating material, space that is formed by an external door plate 6, an internal door plate 7, an upper door cover 8, a lower door cover 9, and a vacuum heat insulating material 3.

The vacuum heat insulating material 3 is disposed in contact with the internal door plate 7. A plurality of protrusions 51 are formed horizontally on the internal door plate 7 at the interior side. The width (vertical width dimension) of each protrusion 51 is equal to or less than 10 mm, and the height of each protrusion 51 (the dimension of the protrusion in the horizontal direction) is equal to or less than 3 mm. The plurality of protrusions 51 are formed over the entire lateral width of the surface of the internal door plate 7. It is disclosed that, according to the above structure, the plurality of protrusions 51 formed on the internal door plate 7 allow the structural strength of the internal door plate 7 to be kept high, which makes it possible to prevent deformation and to prevent, for example, a recess from being formed due to external force. However, it is desirable to further improve the rigidity of the door since heavy goods such as beverages are stored inside the door.

In this respect, the door of the refrigerator of the present embodiment, which includes an internal door plate and an external door plate, is such that space between the internal door plate and the external door plate is filled with a foamed heat insulating material, and such that the door is provided with a vacuum heat insulating material in which an outer skin material including at least a core material is decompression-sealed. Further, the vacuum heat insulating material includes a gas adsorbent.

As shown in FIG. 15, the front openings of the upper freezer compartment 103, the ice compartment 104, the lower freezer compartment 105, and the vegetable compartment 106 of the body of the refrigerator are sealed by the drawer-type doors 103*a*, 104*a*, 105*a*, and 106*a*, respectively, such that these front openings can be freely opened and closed by the respective drawer-type doors. The front opening of the refrigerator compartment 102 is sealed by the swing door 102*a*, such that the front opening of the refrigerator compartment 102 can be freely opened and closed by the door 102*a* which is a single swing door covering the entire opening of the refrigerator compartment 102.

The swing door 102*a* has the greatest area among the plurality of doors of the refrigerator, and is provided with a vacuum heat insulating material 150. The vacuum heat insulating material 150 includes the gas adsorbent 137 therein.

As shown in FIG. 16, the door 102*a* of the refrigerator compartment includes an internal door plate 102*b* and an external door plate 102*c*. A foamed heat insulating material 102*d*, which is made of rigid urethane foam, and the vacuum heat insulating material 150 are included in space between the internal door plate 102*b* and the external door plate 102*c*. In the space, the vacuum heat insulating material 150 is provided in proximity to or in contact with the internal door plate 102*b*.

As previously described in Embodiment 1, the strength of the body of the refrigerator can be increased by including vacuum heat insulating materials (in particular, the vacuum heat insulating materials including the gas adsorbent) in the side and back walls which cover the refrigerator with high coverage.

In particular, in a case where the door provided for the refrigerator compartment 102, which has the greatest area among the doors of the refrigerator, is the swing door 102*a* as in the present embodiment, when the swing door 102*a* is in an opened state, a great load is imposed on the body of the refrigerator (especially on a side wall). Therefore, it is important to increase the strength of the vertical walls.

Accordingly, for such a refrigerator as the one in the present embodiment, increasing the strength in the vertical direction is effective to increase the overall strength. Specifically, a vacuum heat insulating material including the gas adsorbent and having high rigidity is used at portions that contribute to the strength of the refrigerator, and an ordinary vacuum heat insulating material not including the gas adsorbent is used at portions that do not greatly contribute to the strength of the refrigerator. In this manner, a refrigerator with increased overall body strength, improved heat insulating performance, and improved energy saving performance can be provided.

Accordingly, if it is impossible to affix vacuum heat insulating materials to the entire side and back walls to increase the overall body strength of the refrigerator, then vacuum heat insulating materials including the gas adsorbent may be affixed to all of the back and side walls over at least lower portions of these walls, the lower portions having a height that is ½ of the total height of the refrigerator. In this manner, the rigidity of the lower supporting part of the casing (the heat-insulated box) can be greatly improved.

For example, in a case where the swing door 102*a* is provided at the uppermost part of the refrigerator as in the present embodiment, when the door 102*a* is in an opened state, a great load is imposed on the side of the body of the refrigerator, to which side the hinge of the door 102*a* is attached. As a result, the body of the refrigerator becomes inclined, which causes distortion in the horizontal direction. Such an inclination and distortion can be reduced particularly by increasing the rigidity of the lower part of the body of the refrigerator.

In the present embodiment, the swing door 102*a* has the greatest area among the plurality of doors of the refrigerator. Therefore, the swing door 102*a* includes the vacuum heat insulating material including the gas adsorbent.

Accordingly, since the vacuum heat insulating material including the gas adsorbent is capable of suppressing the aging degradation of the vacuum heat insulating material, improved rigidity of the door can be maintained for a long term, and thereby the strength of the door can be kept high for a long term. In addition, the use of the vacuum heat insulating material including the gas adsorbent makes it possible to reduce the thickness of the wall of the door while maintaining the strength of the door, and thus the interior volume of the refrigerator can be increased.

In general, when a door having a large area is used for a long term, there is a possibility that deformation such as a warp occurs at the inside and the outside of the door. However, since the vacuum heat insulating material including the gas adsorbent is capable of suppressing the aging degradation of the vacuum heat insulating material, high rigidity of the door can be maintained for a long term, and thereby the strength of the door can be improved. This makes it possible to prevent a decrease in cooling efficiency that is caused by, for example, cool air leakage due to deformation of the door. As a result, a highly energy-efficient refrigerator can be provided.

In the present embodiment, the degree of vacuum of the vacuum heat insulating material is increased by including the gas adsorbent 137 in the vacuum heat insulating material. That is, as compared to the degree of vacuum of a conventional vacuum heat insulating material (i.e., a vacuum heat insulating material not including the gas adsorbent), the degree of vacuum of the vacuum heat insulating material according to the present embodiment is increased by adsorbing, at normal temperatures, nitrogen contained in a large amount in residual air. Generally speaking, the atmospheric pressure is 100 KPa, and the degree of vacuum of a vacuum heat insulating material is approximately 10 Pa. However, the degree of vacuum of the vacuum heat insulating material used in the present embodiment, in which the gas adsorbent 137 is used, is approximately 1 Pa. The manner of producing the gas adsorbent 137 used in Embodiment 3 may be the same as the manner of producing the gas adsorbent 137 described in Embodiment 1, and the structure of the gas adsorbent 137 used in Embodiment 3 may be the same as the structure of the gas adsorbent 137 described in Embodiment 1.

It should be noted that the rigidity of the vacuum heat insulating material increases and the thermal conductivity of the vacuum heat insulating material decreases in accordance with an increase in the degree of vacuum of the vacuum heat insulating material. Accordingly, under the condition of the same vacuum heat insulating material thickness, the thickness of the wall of the door can be reduced, and the storage capacity and energy saving performance of the refrigerator can be improved as compared to the conventional art.

Moreover, by using the vacuum heat insulating material 150 in which the gas adsorbent 137 is used, the heat insulating performance can be improved significantly. Therefore, it is not necessary for vacuum heat insulating materials to overlap each other in order to suppress the entry of heat. This makes it possible to suppress inconsistency in the wall thickness of the foamed heat insulating material made of the rigid urethane foam, and to prevent deformation of the inner and outer surfaces as well as the occurrence of a void, which are caused when the fluidity of the foamed heat insulating material is hindered at the time of performing the foamed heat insulating material filling process.

In a case where the vacuum heat insulating material is provided at the internal door plate side as in the present embodiment, if the area of the outer skin material 135 is large or the length of the sealed four sides of the outer skin material 135 is long, then air easily enters through the resin internal door plate, which tends to cause a decrease in the degree of vacuum of the vacuum heat insulating material and result in performance degradation. In this respect, by including the gas adsorbent 137 in the vacuum heat insulating material provided in the door as in the refrigerator according to the present embodiment, air that has entered over time during the use of the refrigerator can be adsorbed. As a result, performance degradation can be suppressed during the use of the refrigerator approximately for ten years.

Thus, since the initial performance of the vacuum heat insulating material can be maintained approximately for ten years, excellent energy saving performance realizing low running costs can be provided.

Embodiment 4

Figure 17:
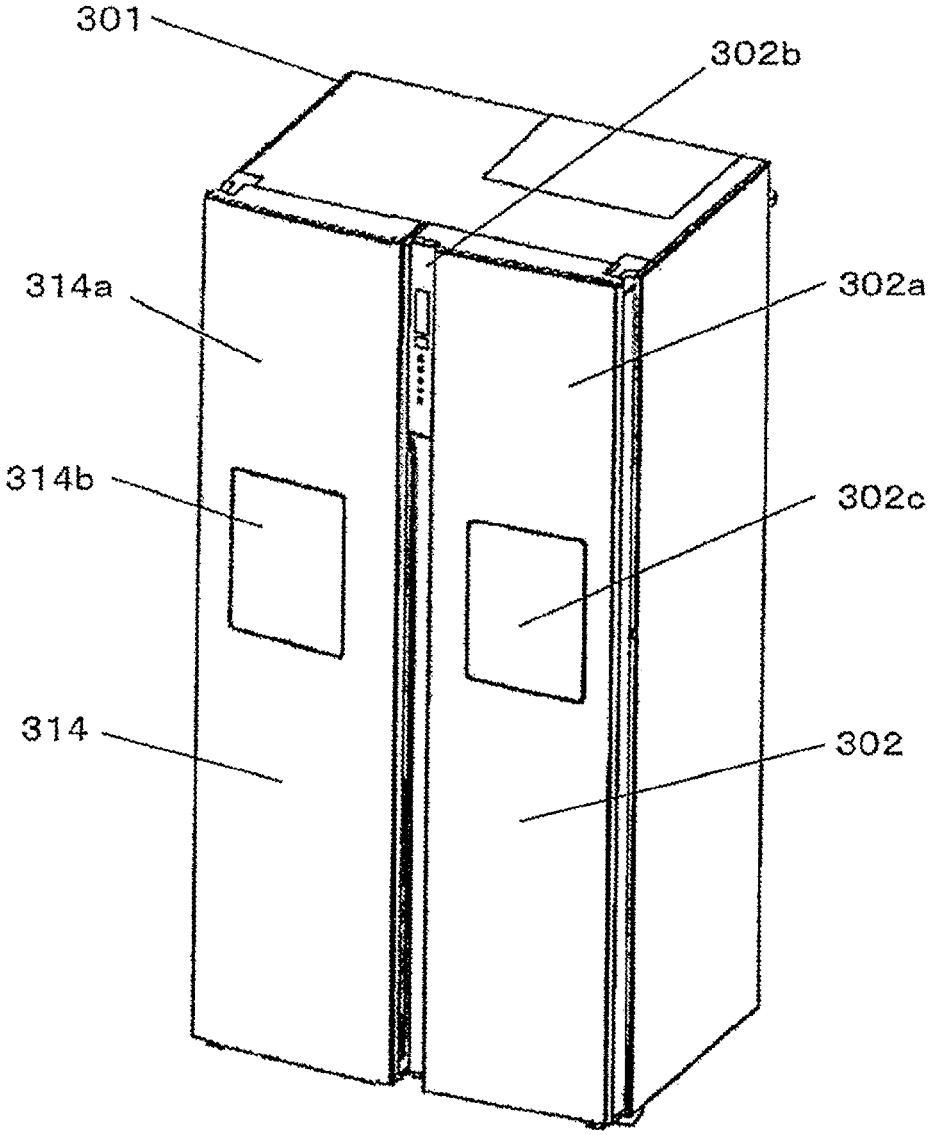
FIG. 17 is a perspective view of a refrigerator according to Embodiment 4 of the present invention.
Figure 18:
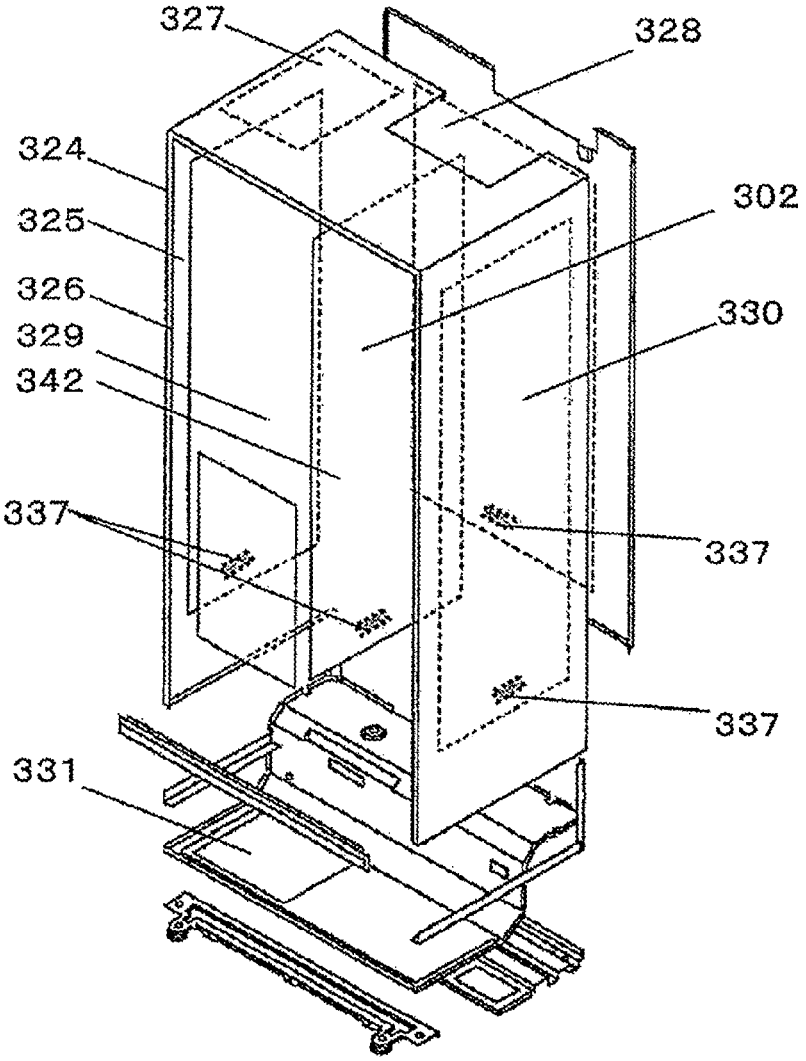
FIG. 18 is an exploded view of the refrigerator according to Embodiment 4 of the present invention.

Hereinafter, another embodiment of the present invention is described with reference to the drawings. It should be noted that, in Embodiment 4, the same configurations as those of Embodiment 1 are denoted by the same reference signs as those used in Embodiment 1, and a detailed description of such configurations is omitted. FIG. 17 is a perspective view of a refrigerator according to Embodiment 4. FIG. 18 is an exploded view of the refrigerator according to Embodiment 4.

As shown in FIG. 17 and FIG. 18, the refrigerator body 301 is a heat-insulated box including: a metal (e.g., steel plate) outer casing 324 with a front opening; a hard resin (e.g., ABS) inner casing 325; and rigid urethane foam which fills between the outer casing 324 and the inner casing 325. The body 301 includes a refrigerator compartment 302 provided at the right side of the body and a freezer compartment 314 provided at the left side of the body. Refrigerators of such a compartment layout have been popular in western countries.

The right side refrigerator compartment 302 includes a swing door 302*a* whose right-side end (rotating proximal end) is connected to the body 301 via a hinge. The door 302*a* includes an external door plate with a notched portion 302*b*. To be more specific, the notched portion 302*b* is formed at part of one end (an end opposite to the rotating proximal end) of the external door plate which forms a metal external surface. The notched portion 302*b* is provided with a display panel with which to change a temperature setting and the like of the refrigerator. The surface of the display panel is formed of a resin.

A relatively large notched portion 302*c* is formed around the center of the door 302*a*. Additional equipment such as an ice dispenser or water dispenser is provided in the notched portion 302*c*.

The adjacent left side freezer compartment 314 also include a swing door 314*a* whose left-side end is connected to the body 301 via a hinge. A relatively large notched portion 314*b* is formed around the center of the door 314*a*. Additional equipment similar to that mentioned above is provided in the notched portion 314*b*.

A foamed heat insulating material and a vacuum heat insulating material are included between external and internal door plates of each of the swing doors 302*a* and 314*a*. The vacuum heat insulating material herein is the vacuum heat insulating material described in Embodiment 1, which includes the gas adsorbent having high nitrogen adsorption performance.

It should be noted that, in the present embodiment, the swing doors 302*a* and 314*a* have almost the same size. These doors are the largest doors among the doors of the refrigerator, and both the doors include the vacuum heat insulating material including the gas adsorbent. However, if there is, for example, a cost limitation, it is effective to attach the vacuum heat insulating material including the gas adsorbent preferentially to the door 314*a* of the freezer compartment for the following reasons: the temperature of the freezer compartment is set to fall within the freezing temperature zone approximately from −20° C. to −40° C., so that deformation such as a warp or the like tends to occur to the door 314*a* due to a significant temperature difference between the inside and outside of the door 314*a*; and the deformation causes significant cool air leakage.

When the doors 302*a* and 314*a* are seen in the thickness direction thereof, the vacuum heat insulating material including the gas adsorbent is disposed in a manner to overlap at least part of the notched portions 302*b*, 302*c*, and 314*b* of the external door plates.

Generally speaking, installation of external door plates including notched portions may cause a risk that the strength of the doors decreases. However, as in the present embodiment, the strength of the doors can be improved by including the vacuum heat insulating material including the gas adsorbent, such that the vacuum heat insulating material overlaps the notched portions in the thickness direction of the doors, and thus a highly reliable refrigerator can be provided.

Moreover, in the case of the refrigerator including large swing doors as above, the body 301 supporting the doors needs to have high rigidity. As shown in FIG. 18, vacuum heat insulating materials 327, 328, 329, 330, 331, and 342 together with rigid urethane foam 326 form the refrigerator body 301. That is, the vacuum heat insulating materials 327, 328, 329, 330, 331, and 342 are inserted in heat insulating walls of the body 301, and gaps are filled with the rigid urethane foam 326.

A specific description is given hereinafter. Among the above vacuum heat insulating materials, the vacuum heat insulating materials 327, 328, 329, and 330 are in contact with and affixed to the inside of the top, back, left side, and right side surfaces of the outer casing 324, respectively. The vacuum heat insulating material 331 is in contact with and affixed to the bottom surface of the inner casing 325. The vacuum heat insulating material 342 is included within a heat insulating partition that partitions off the refrigerator compartment 302 and the freezer compartment 314 from each other. A gas adsorbent 337 is included in each of the vacuum heat insulating materials 328, 329, 330, and 342 provided in the back, left side, and right side walls.

The inside of the heat insulating partition, which insulates and separates between the refrigerator compartment 302 and the freezer compartment 314, is filled with the rigid urethane foam 326. Thus, insulation is made for a temperature difference of 20 K to 30 K between the refrigerating temperature zone of the refrigerator compartment 302 and the freezing temperature zone of the freezer compartment 314. The heat insulating partition forms vertical surfaces extending inside the body 101 from the top to the bottom, and serves as a middle partition. As a result, the refrigerator has high box strength. The heat insulating partition is fixed to the refrigerator before the inside of the heat insulating partition is filled with the rigid urethane foam 326. However, as an alternative, in consideration of ease of production, the heat insulating partition may be fixed to the refrigerator after the inside of the heat insulating partition is filled with the rigid urethane foam 326. In this case, polystyrene foam, which is easy to shape, may be used as a heat insulating material with which to fill the inside of the heat insulating partition, or alternatively, the rigid urethane foam 326 may be separately formed into a plate-shaped board.

In the refrigerator with the above-described configuration, the vacuum heat insulating material 342 includes the gas adsorbent 337 and has high rigidity similar to the vacuum heat insulating materials 328, 329, and 330. As a result, the strength of the body 301 can be improved.

By affixing the vacuum heat insulating material 342 to the freezer compartment 314 side within the heat insulating partition, the heat insulating effect can be improved. In this case, fittings or electrical wires for the lighting of the refrigerator's interior can be attached to a side wall of the refrigerator compartment 302 (specifically, to the refrigerator compartment 302 side of the heat insulating partition). Accordingly, lighting can be attached to a side surface of the refrigerator compartment 302, and thereby usability can be improved.

Since the vacuum heat insulating material 342 includes the gas adsorbent 337, the thermal conductivity of the vacuum heat insulating material is reduced, which makes it possible to reduce heat transfer between the refrigerator compartment 302 and the freezer compartment 314 in addition to obtaining improved rigidity. As a result, the thickness of the heat insulating partition can be reduced, which makes it possible to increase the interior volume while improving the body strength and energy saving performance. In addition, since the heat insulating partition can be made thin, a refrigerator with an excellent design can be provided.

Embodiment 5

Hereinafter, Embodiment 5 of the present invention is described with reference to the drawings. It should be noted that the same configurations as those of Embodiment 1 are denoted by the same reference signs as those used in Embodiment 1, and a detailed description of such configurations is omitted.

Figure 19:
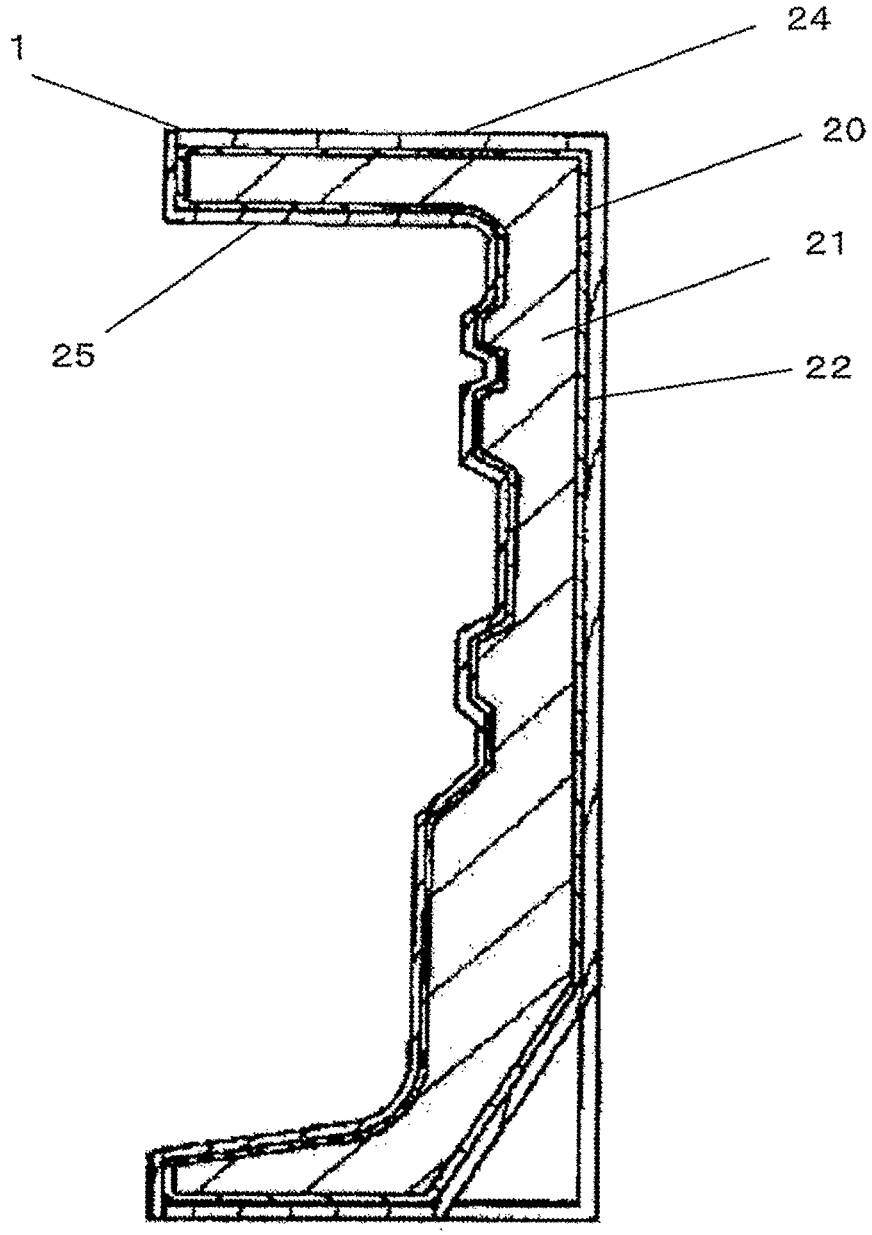
FIG. 19 is a side cross-sectional view of a refrigerator that serves as a comparative example in Embodiment 5 of the present invention.
Figure 20:
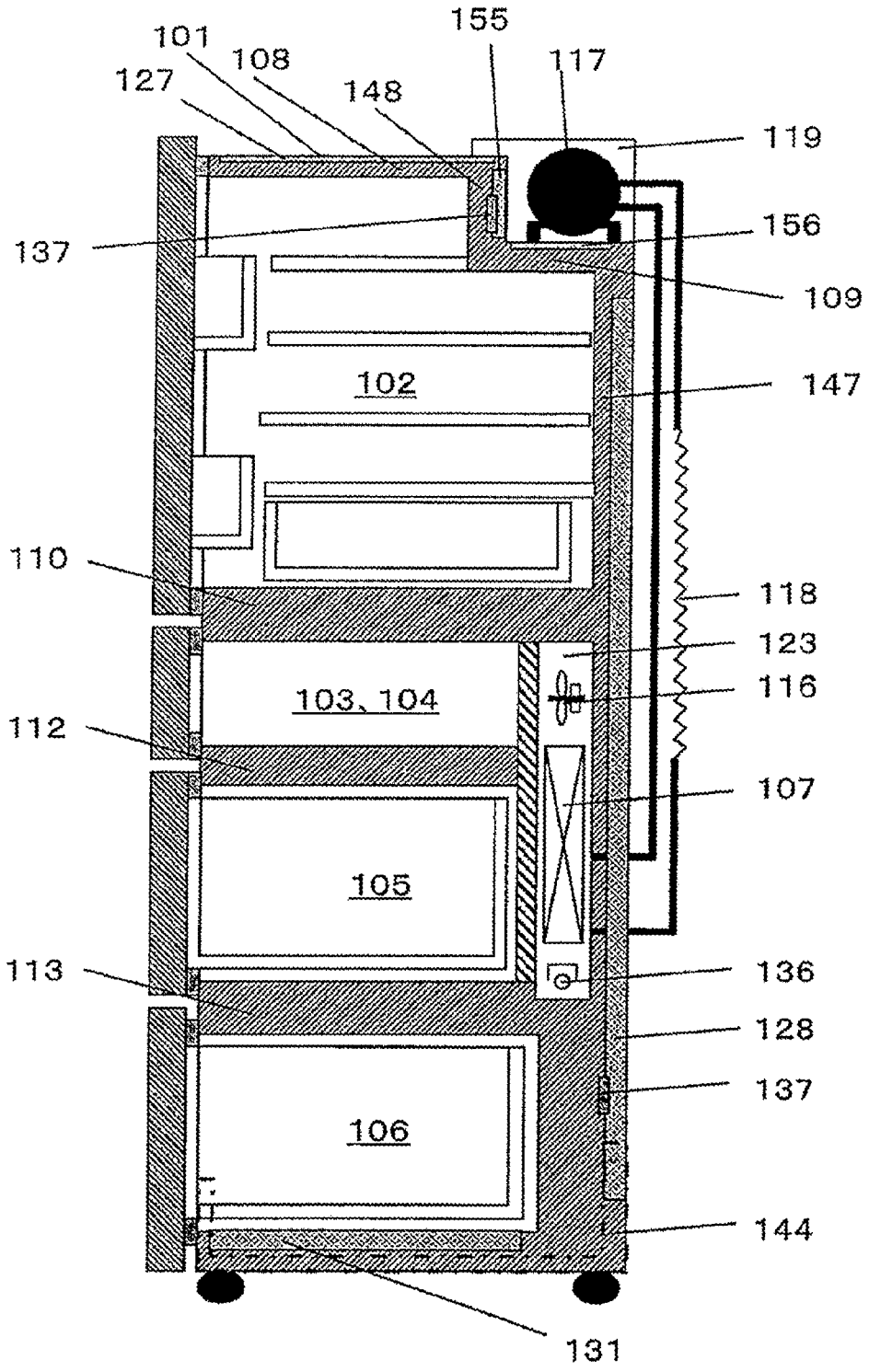
FIG. 20 is a longitudinal sectional view of a refrigerator according to Embodiment 5 of the present invention.
Figure 21:
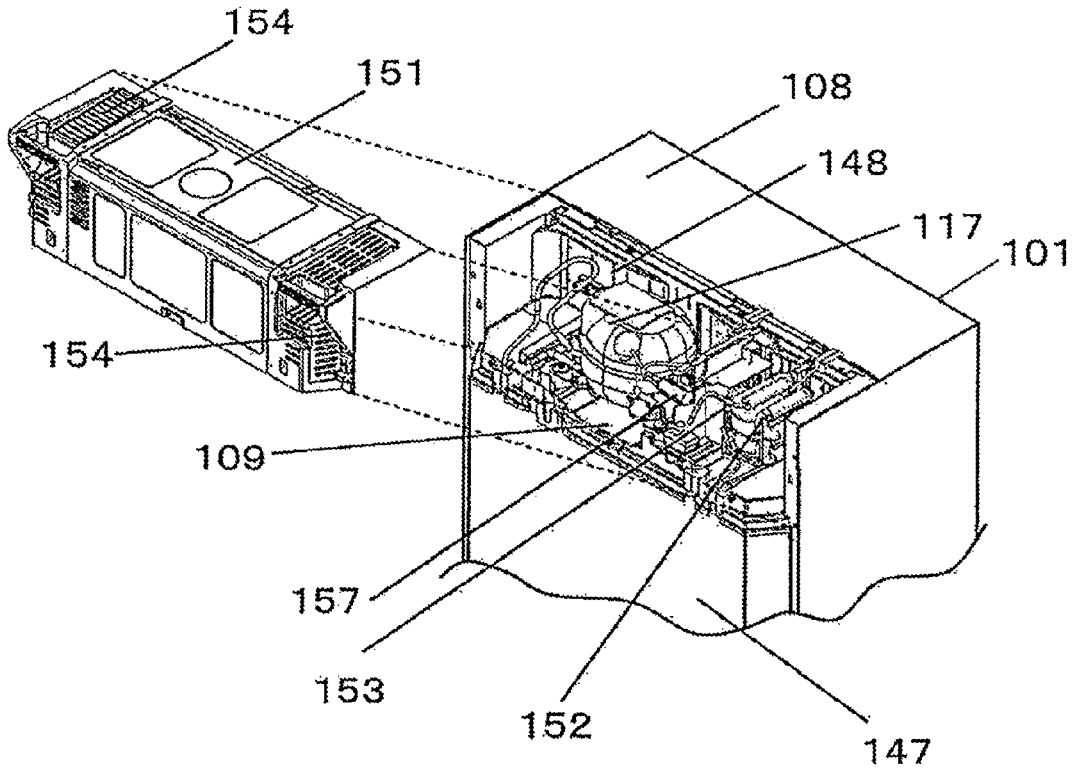
FIG. 21 shows the configuration of a machinery compartment of the refrigerator according to Embodiment 5 of the present invention.

FIG. 19 is a side cross-sectional view of a refrigerator that serves as a comparative example in Embodiment 5. FIG. 20 is a longitudinal sectional view of a refrigerator according to Embodiment 5. FIG. 21 shows the configuration of a machinery compartment of the refrigerator according to Embodiment 5.

First, the refrigerator of the comparative example in Embodiment 5 is described.

FIG. 19 is a side cross-sectional view of a refrigerator disclosed in Japanese Laid-Open Patent Application Publication No. 6-159922. As shown in FIG. 19, a body 1 of the refrigerator is configured such that space formed by an outer casing 24 and an inner casing 25 is entirely covered by a pouch-shaped paper material 20 which is shapable. Inorganic porous filler 21 fills the inside of the paper material 20. A vacuum heat insulating material 22 is disposed along the shape of the space surrounded by the outer and inner casings 24 and 25. A metal foil is provided on both surfaces of the vacuum heat insulating material, and both the surfaces are flat surfaces.

The above configuration makes it possible to readily perform work of storing the vacuum heat insulating material between the outer and inner casings 24 and 25, and to eliminate the necessity of performing gap-sealing work between the vacuum heat insulating material 22 and the outer and inner casings 24 and 25. Moreover, it is disclosed that heat insulating performance is improved since the heat-insulated box can be formed only with the vacuum heat insulating materials 22 without using rigid urethane foam.

However, the refrigerator of the above comparative example has a problem that although the heat insulating performance of the refrigerator of the above comparative example is high, the strength thereof is very low since all of the vacuum heat insulating materials used in the refrigerator are inferior in terms of strength to the rigid urethane foam which is to be disposed in close contact with the outer casing and the inner casing. Moreover, in order to further improve the heat insulating performance of the vacuum heat insulating material, it is effective to use a vacuum heat insulating material in which an aluminum vapor deposition film is used on one flat surface. However, for the refrigerator of the above comparative example, the use of a vacuum heat insulating material in which an aluminum vapor deposition film is used is difficult due to a high possibility of entry of air.

In order to solve the above problems, the refrigerator according to the present embodiment uses a plurality of vacuum heat insulating materials with different degrees of vacuum. Hereinafter, a specific description of the configuration of the refrigerator according to the present embodiment is given.

As shown in FIG. 20 and FIG. 21, the top surface portion of the body 101 of the refrigerator is provided with a recess, such that a downward step toward the back surface of the refrigerator is formed, the recess serving as the machinery compartment 119. To be more specific, the body 101 includes the first top surface portion 108 and a first back surface portion 147, which form the top surface and the back surface of the body 101. The recess serving as the machinery compartment 119 is formed at the back end of the first top surface portion 108 and the top end of the first back surface portion 147. The recess is formed by the second top surface portion 109 and a second back surface portion 148, the second top surface portion 109 being positioned closer to the back surface than the first top surface portion 108 and lower than the first top surface portion 108, the second back surface portion 148 connecting the first top surface portion 108 and the second top surface portion 109. It should be noted that the end of the second top surface portion 109 at the back surface side is connected to the top end of the first back surface portion 147. The compressor 117, a condenser 152, heat radiation piping (not shown) for use in heat radiation, a dryer 157 for use in moisture removal, a machinery compartment fan 153, and an inlet of the capillary tube 118 are arranged in the recess serving as the machinery compartment 119.

The machinery compartment 119 is covered by a machinery compartment cover 151. The machinery compartment cover 151 is provided with air flow holes 154, through which cooling down of the compressor 117 and the condenser 152 is performed by means of forced convection with the machinery compartment fan 153. The machinery compartment cover 151 is detachably provided at the top of the first top surface portion 108 and the second top surface portion 109 via screws or the like.

The refrigerator includes a refrigeration cycle which is formed by sequentially connecting the compressor 117, the condenser 152, the heat radiation piping (not shown) for use in heat radiation, the dryer 157 for use in moisture removal, the capillary tube 118, and a cooling device 107 in a circular pattern. A cooling medium is enclosed in the refrigeration cycle, and thus a cooling operation is performed. In recent years, a combustible cooling medium is often used as the cooling medium for environmental protection purposes. It should be noted that in a case where the refrigeration cycle uses valves such as a three-way valve and a change-over valve, such functional components may be disposed in the machinery compartment.

The condenser 152 may be a forced convection condenser that may be combined with: piping for use in natural heat radiation utilizing the surrounding steel plates of the refrigerator; and piping for use in preventing dripping of water, which is disposed at partitions between heat insulating doors of the respective compartments. The condenser 152 may be configured as a thin condenser with high efficiency such as a wire condenser, fin coil condenser, or spiral fin condenser, which may be accommodated in the machinery compartment 119.

Vacuum heat insulating materials 127, 128, 129, 130, 131, 155, and 156 together with the rigid urethane foam 126 form the body 101 of the refrigerator. To be specific, among the above vacuum heat insulating materials, the vacuum heat insulating materials 127, 128, 129, and 130 are in contact with and affixed to the inside of the first top surface portion 108, the first back surface portion 147, the body left side surface, and the body right side surface of the outer casing 124 (more specifically, in contact with and affixed to the outer casing in respective heat insulating walls). The vacuum heat insulating materials 155 and 156 are in contact with and affixed to the inside of the second back surface portion 148 and the second top surface portion 109 (more specifically, in contact with and affixed to the outer casing in respective heat insulating walls). The vacuum heat insulating material 131 is in contact with and affixed to the bottom surface of the inner casing 125 (more specifically, in contact with and affixed to the inner casing in a corresponding heat insulating wall).

Further, as shown in FIG. 20, among the above vacuum heat insulating materials, each of the vacuum heat insulating materials 128, 129, 130, and 156 includes the gas adsorbent 137 therein, and the other vacuum heat insulating materials do not include the gas adsorbent.

With such presence and absence of the gas adsorbent, the rigidity can be varied among vacuum heat insulating materials. Specifically, vacuum heat insulating materials including the gas adsorbent have high rigidity, and vacuum heat insulating materials not including the gas adsorbent have low rigidity. The rigidity herein refers to rigidity per unit volume. In the description herein, the definition of rigidity being varied excludes, for example, the following case: the rigidities of overall vacuum heat insulating materials are different from each other since the vacuum heat insulating materials are different from each other in terms of size or thickness although they are produced from the same material and by the same method.

In the present embodiment, a plurality of vacuum heat insulating materials having different rigidities are used, and thereby the strength of the body 101 of the refrigerator is improved. In particular, among the plurality of vacuum heat insulating materials, the vacuum heat insulating materials 128, 129, and 130 having high rigidity are included in the refrigerator's side and back walls which cover the refrigerator with high coverage. In this manner, the strength of the body 101 can be improved.

Accordingly, if it is impossible to affix vacuum heat insulating materials to the entire side and back walls to increase the strength of the overall body 101 of the refrigerator, then it is preferred that vacuum heat insulating materials including the gas adsorbent be affixed to all of the back and side walls over at least lower portions of these walls, the lower portions having a height that is ½ of the total height of the body of the refrigerator. In this manner, the rigidity of the lower supporting part of the casing can be greatly improved.

It should be noted that the refrigerator according to the present embodiment shares common features with the refrigerators according to the previously described embodiments regarding, for example, the structure and arrangement of the vacuum heat insulating materials and the presence/absence of the gas adsorbent. Since such common features exert the same operational advantages as those previously described, a repetition of the same description of such common features and operational advantages is avoided in the present embodiment.

In the present embodiment, the vacuum heat insulating material is disposed in at least one of the second back surface portion 148 and the second top surface portion 109. The second back surface portion 148 serves as the front surface of the compressor 117, and the second top surface portion 109 serves as the bottom surface of the compressor 117. The vacuum heat insulating material includes the gas adsorbent. FIG. 20 shows one example where the vacuum heat insulating material that is disposed in the second back surface portion 148 includes the gas adsorbent 137.

This realizes a structure with further improved strength and energy saving performance. In addition, the structure exhibits high heat insulation capacity against heat that is generated around the machinery compartment 119 including the compressor 117 whose temperature is high. Therefore, exhaust heat from the compressor 117 is suppressed from being transmitted to the interior of the refrigerator, which makes it possible to suppress an increase in the temperature of the refrigerator interior and to improve energy saving performance.

Moreover, since the second top surface portion 109, which serves as a support for the compressor 117 and the machinery compartment fan 153, includes the vacuum heat insulating material, the rigidity of the support is increased, and thus propagation of noise and vibration can be suppressed.

The degree of such noise and vibration suppression effect varies depending on where the vacuum heat insulating material is disposed. As in the present embodiment, if the vacuum heat insulating material is disposed in the second back surface portion 148 at the outer casing side so as to be positioned at the front of the compressor 117, then the propagation of noise due to vibration of, for example, the compressor 117 can be suppressed, and thereby forward noise transmission (transmission of noise to the interior of the refrigerator) can be suppressed. If the vacuum heat insulating material is disposed in the second top surface portion 109 at the outer casing side, then a high vibration suppression effect can be obtained at the surface where the compressor 117 is mounted. If the vacuum heat insulating material is disposed in the second top surface portion 148 at the inner casing side, then noise that tend to attenuate while passing through the rigid urethane foam 126 is further blocked by the inner vacuum heat insulating material, and thus forward noise propagation (propagation of noise to the interior of the refrigerator) can be suppressed.

Further, in the present embodiment, the vacuum heat insulating material including the gas adsorbent 137 is disposed in the heat insulating wall forming the second back surface portion 148 out of the heat insulating walls forming the second back surface portion 148 and the second top surface portion 109, the second back surface portion 148 having a less heat insulating wall thickness than the second top surface portion 109. As a result, the second back surface portion 148 exerts high heat insulating performance regardless of its small wall thickness.

The refrigerator interior side of the second back surface portion 148 is positioned at the upper part of the refrigerator compartment 102. In the present embodiment, in order to perform forced-circulation cooling with a cool air sending fan 116 by using cool air in the refrigerator interior, a duct through which cool air discharged by the cool air sending fan 116 flows is disposed in the back surface portion (inside the heat insulating wall) of the refrigerator compartment 102, and a feed-in inlet through which the cool air is fed into the refrigerator compartment is provided at an upper position in the back surface of the refrigerator compartment. The temperature of the cool air is approximately −10 to −20° C. For example, assuming that the temperature of the machinery compartment reaches approximately 33° C. when the outdoor temperature is 25° C., then the temperature difference between the cool air and the machinery compartment 119 is approximately 43 to 53 K. Accordingly, an increase in the temperature of the fed-in cool air can be suppressed and energy saving performance can be improved by affixing the highly-insulating vacuum heat insulating material including the gas adsorbent 137 to the second back surface portion 148, which has a thin heat insulating wall and which separates significantly different temperatures.

It should be noted that in a case where the vacuum heat insulating material including the gas adsorbent 137 is disposed, the thickness of the vacuum heat insulating material can be reduced if the heat insulating performance to be obtained is the same as that of conventional art. Accordingly, even at the second back surface portion 148 where the wall thickness is thin, the fluidity of the rigid urethane foam 126 is not hindered. In the present embodiment, the thickness of the second back surface portion 148 is 27 mm, and the thickness of the vacuum heat insulating material including the gas adsorbent 137 is approximately 8 mm. As a result, a wall thickness (gap) of 19 mm can be obtained at a portion where the rigid urethane foam 126 flows. Therefore, fluidity-hindering factors such as the occurrence of a void do not arise.

Since the vacuum heat insulating material including the gas adsorbent realizes reduced thermal conductivity, if the heat insulating performance of a heat insulating wall to be obtained is the same as that of conventional art, then as an alternative method, the thickness of the rigid urethane foam 126 may be reduced. In this case, through the reduction of the wall thickness, not only an increase in the interior volume of the refrigerator but also a reduction in the usage amount of rigid urethane foam 126 can be realized. As a result, the cost and weight of a final product can be reduced. Moreover, since the weight of the upper part of the body is reduced and the center of gravity of the body is lowered, overturning of the refrigerator can be advantageously prevented.

In the present embodiment, the vacuum heat insulating material including the gas adsorbent 137 is disposed in the heat insulating wall forming the second back surface portion 148 out of the heat insulating walls forming the second back surface portion 148 and the second top surface portion 109, the second back surface portion 148 having a larger area of projection onto the refrigerator compartment, i.e., onto the interior of the refrigerator, than the second top surface portion 109 when these heat insulating walls are seen in the thickness direction thereof.

As a result, an area covered by the vacuum heat insulating material including the gas adsorbent 137 can be made large, which makes it possible to improve energy saving performance while suppressing heat transmission to the refrigerator interior and temperature increase in the refrigerator interior. Moreover, the strength of the refrigerator can be improved, and the area of propagation of noise and vibration to the refrigerator interior can be reduced to a greater degree. As in the present embodiment, if the vacuum heat insulating material including the gas adsorbent is disposed at the second back surface portion 148, which is widely covered by the vacuum heat insulating material and positioned at a height similar to the height of the head of a user, then a path of propagation of noise and vibration to the user standing in front of the refrigerator from the back of the refrigerator where the compressor 117 and the machinery compartment fan 153 are disposed can be blocked.

On the other hand, if the second top surface portion 109 has a larger area of projection onto the refrigerator compartment 102, i.e., onto the interior of the refrigerator, then it is conceivable to provide the vacuum heat insulating material including the gas adsorbent in the second top surface portion 109. In this case, the rigidity of the second top surface portion 109 supporting the compressor 117 and the machinery compartment fan 153 is increased, and thus a higher vibration suppression effect is obtained.

In the present embodiment, the vacuum heat insulating material including the gas adsorbent 137 is disposed in the heat insulating wall forming the second back surface portion 148 out of the heat insulating walls forming the second back surface portion 148 and the second top surface portion 109, the second back surface portion 148 being closer in distance to the compressor 117 than the second top surface portion 109.

For example, if the temperature of the machinery compartment is approximately 33° C., then as described above, the temperature difference between the cool air (−10 to −20° C.) sent to the freezer compartment 102 and the machinery compartment 119 is approximately 43 to 53 K. However, the temperature of the compressor 117 which is a heat generating portion in the machinery compartment 119 is higher, which becomes as high as approximately 45 to 50° C. although the temperature of the compressor 117 depends on the state of the refrigeration cycle which is affected by the speed of the compressor 117 and load fluctuation of the refrigerator. Therefore, in this case, the temperature difference between the aforementioned cool air and the compressor 117 is as great as 60 to 73 K, indicating a great temperature gradient. By disposing the vacuum heat insulating material including the gas adsorbent 137, which exhibits low thermal conductivity, at such a portion where a great temperature difference occurs, a high heat insulating effect can be obtained, and energy saving performance can be improved while suppressing propagation of heat from the compressor 117 itself and exhaust heat from the compressor 117 to the refrigerator interior and suppressing an increase in the temperature of the refrigerator interior.

Moreover, since the temperature of the gas adsorbent 137 is suitably increased due to an influence of the temperature of exhaust heat from the compressor 117, the activity of the gas adsorbent 137 is increased and the gas adsorption effect is increased. As a result, the degree of vacuum of the vacuum heat insulating material of the second back surface portion 148 is further increased. Consequently, the thermal conductivity of the second back surface portion 148 is reduced, and the strength of the second back surface portion 148 is improved, which realizes high energy saving performance and high external strength of the refrigerator.

Embodiment 6

Figure 22:
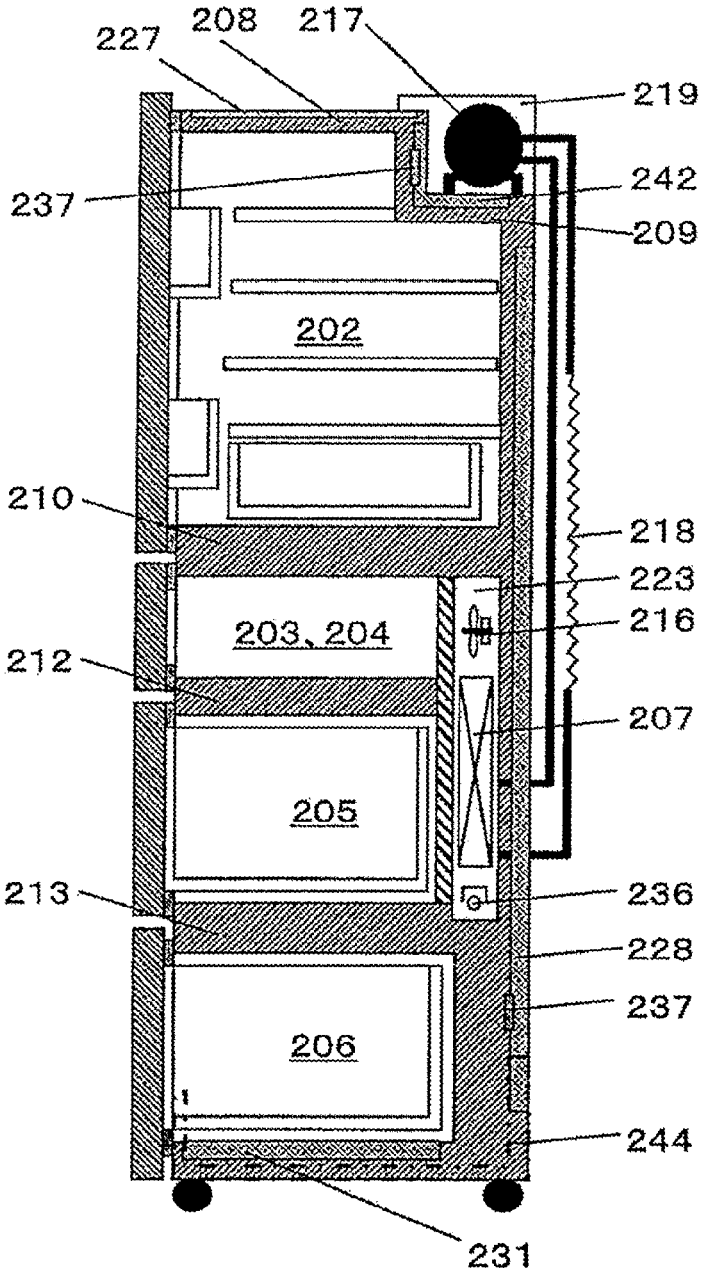
FIG. 22 is a longitudinal sectional view of a refrigerator according to Embodiment 6 of the present invention.

FIG. 22 is a longitudinal sectional view of a refrigerator according to Embodiment 6 of the present invention. It should be noted that the same configurations as those of Embodiment 1 are denoted by the same reference signs as those used in Embodiment 1, and a detailed description of such configurations is omitted.

As shown in FIG. 22, a body 201 of the refrigerator is a heat-insulated box including: a metal (e.g., steel plate) outer casing 224 with a front opening; a hard resin (e.g., ABS) inner casing 225; and rigid urethane foam 226 which fills between the outer casing 224 and the inner casing 225. The interior of the body 201 is divided into a plurality of compartments. In the present embodiment, the body 201 includes: a refrigerator compartment 202 provided at the upper part of the body 201; an upper freezer compartment 203 provided below the refrigerator compartment 202; an ice compartment 204 provided parallel to the upper freezer compartment 203 below the refrigerator compartment 202; a vegetable compartment 206 provided at the lower part of the body; and a lower freezer compartment 205 provided between the vegetable compartment 206 and the upper freezer compartment 203 and ice compartment 204 which are arranged in parallel to each other.

Front openings of the upper freezer compartment 203, the ice compartment 204, the lower freezer compartment 205, and the vegetable compartment 206 are sealed by respective drawer-type doors, such that these front openings can be freely opened and closed by the respective drawer-type doors. The front opening of the refrigerator compartment 202 may be sealed by, for example, a double door, such that the front opening can be freely opened and closed by the double door.

Vacuum heat insulating materials 227, 228, 229, and 230 are in contact with and affixed to the inside of a first top surface portion 208, a first back surface portion 247, the body left side surface, and the body right side surface of the outer casing 224. A vacuum heat insulating material 242, which is a single body, is in contact with and affixed to the inside of a second back surface portion 248 and a second top surface portion 209 so as to be bent along the second back surface portion 248 and the second top surface portion 209. That is, the vacuum heat insulating material 242 includes a portion affixed to the second back surface portion 248 and a portion affixed to the second top surface portion 209. These two portions are connected at a connection between the second back surface portion 248 and the second top surface portion 209, and form an L shape when seen in side view as shown in FIG. 22. A vacuum heat insulating material 231 is in contact with and affixed to the bottom surface of the inner casing 225.

Vacuum heat insulating materials 228, 229, 230, and 242 each include a gas adsorbent 237 therein. In particular, the vacuum heat insulating material 242 includes the gas adsorbent 237 at a portion that corresponds to the second back surface portion 248.

In this manner, the vacuum heat insulating material 242 including the gas adsorbent 237 and having low thermal conductivity is disposed such that a machinery compartment 219, which causes a great temperature difference, is covered from forward and below by the vacuum heat insulating material 242. As a result, a higher heat insulating effect can be obtained. Consequently, energy saving performance can be improved while suppressing propagation of heat from a compressor 217 itself and exhaust heat from the compressor 217 to the refrigerator interior and suppressing an increase in the temperature of the refrigerator interior.

As with Embodiment 5, the temperature of the gas adsorbent 237 provided corresponding to the second back surface portion 248 is suitably increased, and thereby the activity of the gas adsorbent 237 is increased. As a result, an increased gas adsorption effect is obtained; the vacuum heat insulating material 242 with a further increased degree of vacuum can be provided; and low thermal conductivity and improved strength are obtained. This consequently realizes high energy saving performance and high external strength of the refrigerator.

Further, as with Embodiment 5, a path of propagation of noise and vibration to a user standing in front of the refrigerator from the back of the refrigerator can be advantageously blocked.

Still further, as described above in the present embodiment, the vacuum heat insulating material 242 provided in the second back surface portion 248 and the second top surface portion 209 forming the recess is a single body. This makes it possible to more effectively suppress propagation of heat to the refrigerator interior from heat generating portions provided in the recess such as the compressor 217.

Embodiment 7

Hereinafter, Embodiment 7 of the present invention is described with reference to the drawings. It should be noted that the same configurations as those of Embodiment 1 are denoted by the same reference signs as those used in Embodiment 1, and a detailed description of such configurations is omitted.

Figure 23:
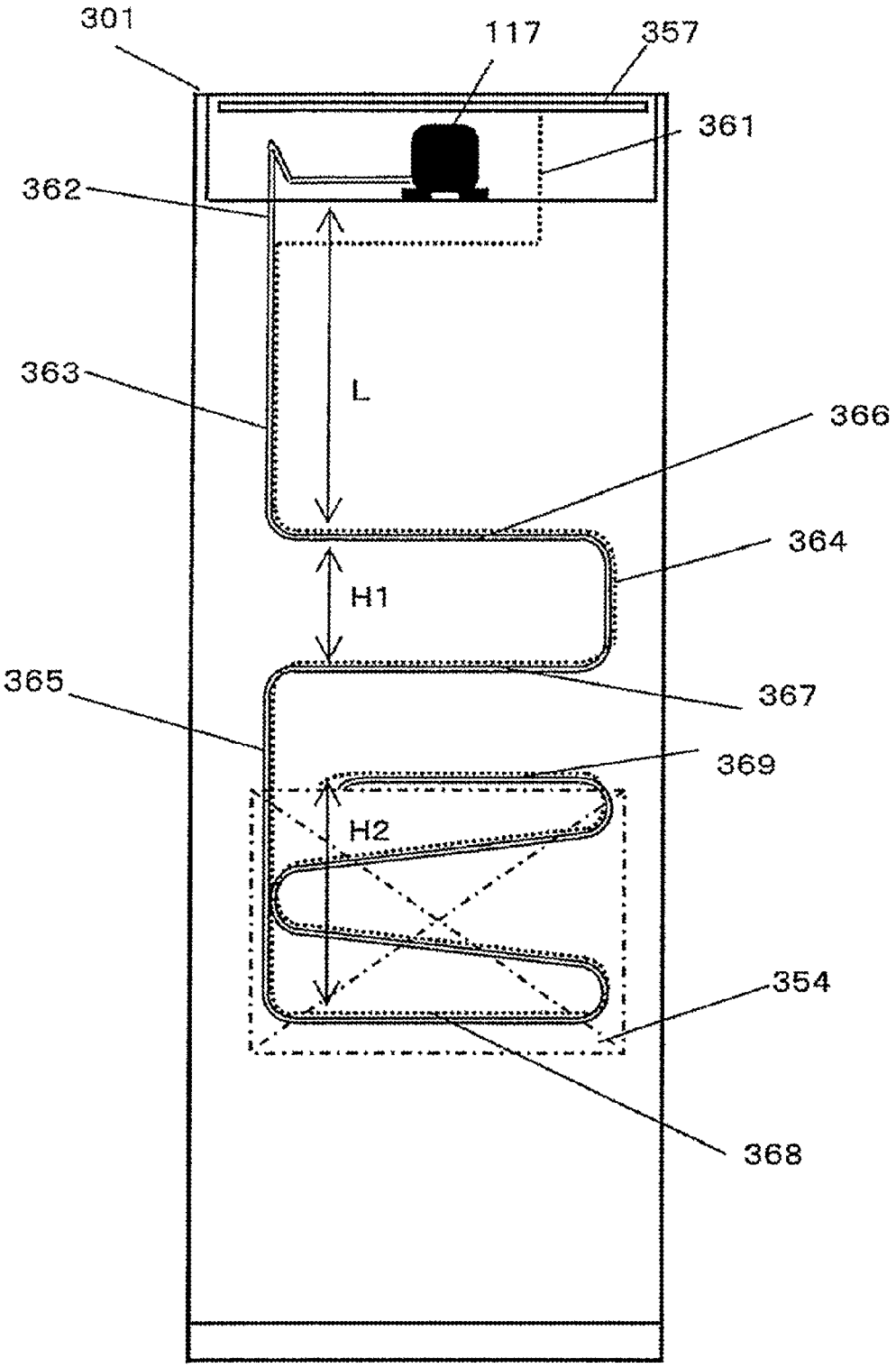
FIG. 23 is a rear view of a refrigerator according to Embodiment 7 of the present invention.

FIG. 23 is a rear view of a refrigerator according to Embodiment 7, schematically showing the arrangement of main piping forming a refrigeration cycle circuit. The refrigeration cycle circuit included in the body 301 of the refrigerator is formed by connecting the compressor 117, a condenser 357, a capillary tube which is a decompressor, a dryer for use in moisture removal (not shown), an evaporator 354, and suction piping 362 in a circular pattern. It should be noted that, in FIG. 23, the capillary tube 361 is indicated by a dashed line and the suction piping 362 is indicated by a double line in order to clarify their differences from other piping. The placement of the evaporator 54 is indicated by dashed-dotted lines.

The suction piping 362 connects the evaporator 354 and the compressor 117. The diameter of the capillary tube 361 is less than the diameter of the suction piping 362. The capillary tube 361 is piping connecting the condenser 357 and the evaporator 354.

The length of the suction piping 362 is substantially the same as that of the capillary tube 361. The suction piping 362 and the capillary tube 361, except their end portions, are soldered to each other so as to be able to exchange heat with each other, thereby forming a heat exchanger 363. In order to obtain a sufficient length of heat exchange portion, the heat exchanger 363 includes a first bent portion 364 and a second bent portion 365, each of which is curved and bent to be substantially in a horizontal U shape. The first bent portion 364 and the second bent portion 365 are arranged so as to connect horizontal transverse portions 366, 367, and 368. Further, a bent portion connecting horizontal transverse portions 368 and 369 is formed to be substantially in a W shape.

Upper end portions of the capillary tube 361 and the suction piping 362 protrude from a notched portion (not shown) formed at an edge of the machinery compartment, and are connected to the compressor 117 and the condenser 357. Lower end portions of the capillary tube 361 and the suction piping 362 protrude from the inner casing and are connected to the evaporator 354.

A vertical length L of the suction piping 362 between the bottom of the compressor 117 and the first bent portion 364 is greater than a height H1 of the first bent portion 364. A height H2 of the second bent portion 365 is greater than the height H1 of the first bent portion 364.

A passage of the suction piping 362 extending from the compressor 117 to the evaporator 354 is further described below. One end of the suction piping 362 extends from the compressor 117 through the machinery compartment, and extends downward at one side within the back wall of the refrigerator. The suction piping 362 is bent at a particular point and then extends as the horizontal transverse portion 366 toward the other side. Thereafter, the extending direction of the piping is turned around by the first bent portion 364, such that the piping extends toward the one side. After the extending direction is turned around, the piping extends as the horizontal transverse portion 367 below the horizontal transverse portion 366 toward the one side. Next, the extending direction of the suction piping 362 is again turned around by the second bent portion 365 toward the other side, such that the piping extends toward the other side as the horizontal transverse portion 368. Thereafter, from the end of the horizontal transverse portion 368, the aforementioned W-shaped bent portion is formed such that the piping turns around upward to extend toward the one side, then turns around upward to extend toward the other side, and thereafter turns around upward again to extend toward the one side. Then, the horizontal transverse portion 369 extends toward the one side and reaches the evaporator 354. The W-shaped bent portion and the horizontal transverse portion 369 are arranged between the horizontal transverse portions 367 and 368.

The compressor 117 is a reciprocating compressor. The direction of the reciprocating motion of the piston of the compressor is a horizontal direction substantially parallel to the back surface, that is, the direction of the reciprocating motion of the piston is substantially parallel to the horizontal transverse portions 366, 367, 368, and 369.

Figure 24:
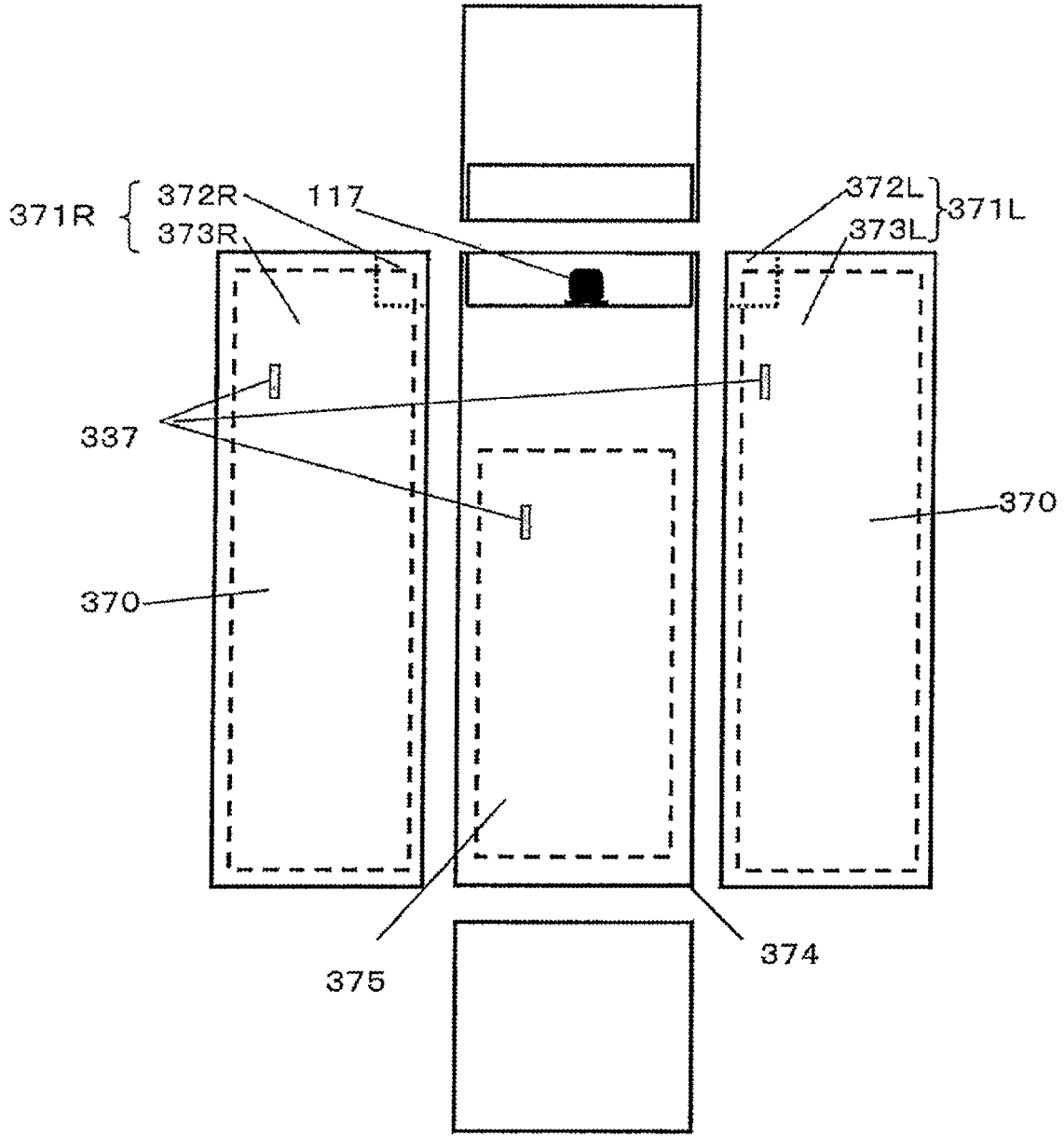
FIG. 24 is a development view of the refrigerator according to Embodiment 7 of the present invention
Figure 25:
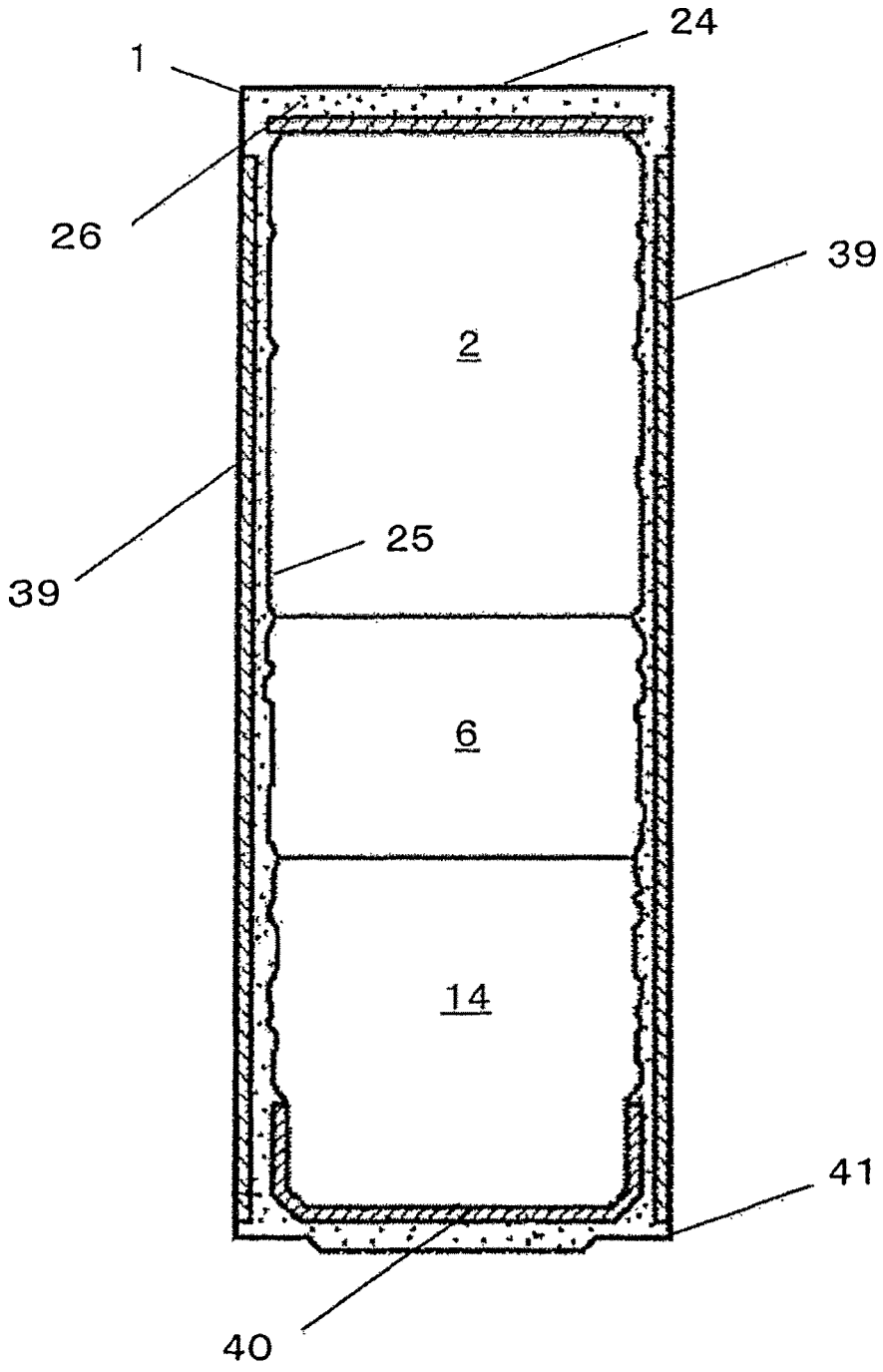
FIG. 25 is a front cross-sectional view of a refrigerator according to conventional art.

FIG. 24 is a development view of the refrigerator according to Embodiment 7 of the present invention, in which the front side of the refrigerator is not shown. With reference to FIG. 24, positions in which vacuum heat insulating materials are embedded are described. In FIG. 24, developed views of respective faces of the heat-insulated box are shown, in which: the back of the heat-insulated box is shown at the center of the drawing; the top of the heat-insulated box is shown at the upper part of the drawing; the bottom of the heat-insulated box is shown at the lower part of the drawing; and the sides of the heat-insulated box are shown at the right and left of the drawing.

A vacuum heat insulating material 370 including a gas adsorbent 337 is included in each of side walls 371L and 371R. In FIG. 24, at the top of the left side wall 371 L, a first projected portion 372 L is shown, which is a left-side projected area of the recess formed in the top surface (i.e., the recess forming the machinery compartment). Also, on the side wall 371 L, a second projected portion 373 L is shown, which is a left-side projected area of the entire interior space of the body 301. The vacuum heat insulating material 370 is embedded in an area that covers 80% or more, i.e., almost the entirety, of the left side wall of the body 301, the area including at least part of the first projected portion 372 L and extending across the second projected portion 373 L. As shown in FIG. 24, the same is true of the right side wall 371R.

A vacuum heat insulating material 375 including the gas adsorbent 337 is affixed in a back wall 374, such that the area of a portion to which the vacuum heat insulating material is affixed is less than in the above case of the side wall, the portion covering approximately 50% to 70% of the entire back wall. The vacuum heat insulating material 375 included in the back wall 374 is disposed at least along the back of the freezer compartment whose temperature is maintained to fall within the freezing temperature zone. It should be noted that each of these gas adsorbents 337 is the powdered ZSM-5 zeolite previously described in detail in Embodiment 1, which is excellent in terms of nitrogen adsorbing performance.

Functions of the refrigerator configured in the above-described manner are described below.

In the present embodiment, the suction piping 362 including the horizontal transverse portions 366, 367, 368, and 369 is provided between the inner and outer casings forming the back wall. In this manner, the rigidity of the back wall in the left-right direction (horizontal direction) is improved. Meanwhile, the vacuum heat insulating material including the vertically extending deformed portions 130*a* as described in Embodiment 1 is included in the left and right side walls of the body 301. Thus, the suction piping 362 functions as a reinforcing member in the horizontal direction of the back wall; and the deformed portions 130*a*, which extend vertically straight and which are included in the vacuum heat insulating materials included in the side walls 101*a*, function as reinforcing portions of the side walls 101*a* in the vertical direction. Moreover, the rigidity of the back wall in the horizontal direction contributes to firm connection between the left and right side walls. As a result, the rigidity of the entire body 301 is improved.

The first bent portion 264 connecting horizontal transverse portions is embedded in the heat insulating wall between the compressor 117 and the evaporator 354. The second bent portion 265 is embedded in the heat insulating wall at the back of the evaporator 254. As a result, the strength (rigidity) of the back heat insulating wall is improved at the respective positions.

Accordingly, even though the vacuum heat insulating material covers the back wall of the refrigerator with lower coverage than the coverage of each side wall by the vacuum heat insulating material, the strength of the back wall is improved particularly in the horizontal direction. Thus, the rigidity of the side walls is increased, and in addition, the rigidity of the back wall connecting the side walls is increased particularly in the horizontal direction, which makes it possible to improve the rigidity of the entire body 301 which is the heat-insulated box of the refrigerator.

As described above, the vacuum heat insulating material including the vertically extending deformed portions 130*a* is included in the left and right side walls of the body 301, and thereby the rigidity of the side walls is increased. Moreover, the back wall connecting the left and right side walls includes the suction piping 362, and thereby the rigidity of the back wall in the left-right direction (horizontal direction) is increased.

In this manner, a structure increasing the rigidity of the side walls and a structure increasing the rigidity of the back wall are combined, which reduces a strength difference between the back wall and each side wall of the heat-insulated box. This makes it possible to improve the rigidity of the entire refrigerator.

In the present embodiment, each vacuum heat insulating material 370 is in close contact with and affixed to an inner surface of the outer casing of the heat-insulated box. Therefore, at the time of filling the heat-insulated box with the rigid urethane foam, only the thickness of the vacuum heat insulating material 370 and one side of the vacuum heat insulating material 370 need to be taken into consideration. Accordingly, as compared to a configuration where the vacuum heat insulating material is disposed at the middle position in each of the left and right side walls, the thickness of the left and right side walls can be reduced, and the volume of the storage compartments can be increased, which makes it possible to provide a refrigerator with increased heat insulation capacity and rigidity.

Further, according to the present embodiment, the vacuum heat insulating materials 370 are embedded in the side walls, such that the vacuum heat insulating materials 370 cover at least part of the left-side and right-side projected areas 372 L and 372 R of the recess formed in the top surface of the heat-insulated box whose strength tends to be reduced at the recess. In this manner, the rigidity of particularly the upper part of the side walls can be improved.

Still further, the suction piping 362 includes the first bent portion 364 and the second bent portion 365. This makes it possible to further improve the strength of the heat insulating wall at the back of the evaporator 354, which thermally contracts and expands repeatedly due to cooling and heating of the evaporator 354.

INDUSTRIAL APPLICABILITY

The present invention is applicable to household refrigerators which are required to be environmentally friendly and high-grade finished, and reduce running costs to realize energy saving.

REFERENCE SIGNS LIST

101, 201, 301 body
108, 208 first top surface portion
109, 209 second top surface portion
110, 111, 112, 113 heat insulating partition
127, 128, 129, 130, 131, 38, 155 vacuum heat insulating material
227, 228, 231, 242 vacuum heat insulating material
132 core material
133 packaging material
134 member
135 outer skin material
137, 237 gas adsorbent
147, 247 first back surface portion
148, 248 second back surface portion

The invention claimed is:

1. A refrigerator comprising:

a heat-insulated box including an inner casing and an outer casing, in which space between the inner casing and the outer casing is filled with a foamed heat insulating material; and a vacuum heat insulating material disposed in the heat-insulated box together with the foamed heat insulating material, the vacuum heat insulating material including an outer skin material, the outer skin material including at least a core material and being decompression-sealed, wherein the vacuum heat insulating material includes a gas adsorbent, and the vacuum heat insulating material is included in at least a side wall of the heat-insulated box, the vacuum heat insulating material has a rectangular plate shape and includes a core-less portion in at least one of four corners of the vacuum heat insulating material, the core-less portion not including the core material, the core-less portion is folded back along a folding line that is a straight line crossing two sides of the vacuum heat insulating material, the two sides forming the at least one corner, such that the at least one of four corners includes a multi-layered portion, and the gas adsorbent is disposed at a position away from the multi-layered portion.

2. The refrigerator according to claim 1, wherein the vacuum heat insulating material including the gas adsorbent is disposed in both left and right side walls of the heat-insulated box, and a main surface of the vacuum heat insulating material disposed in the left side wall has an area equal to that of a main surface of the vacuum heat insulating material disposed in the right side wall.

3. The refrigerator according to claim 1, wherein the vacuum heat insulating material including the gas adsorbent is disposed in a back wall of the heat-insulated box.

4. The refrigerator according to claim 1, wherein the heat-insulated box is provided with a heat generating portion, and the gas adsorbent included in the vacuum heat insulating material is positioned not to be adjacent to the heat generating portion of the heat-insulated box.

5. The refrigerator according to claim 1, wherein the heat-insulated box is provided with a heat generating portion, and the gas adsorbent included in the vacuum heat insulating material is positioned not to overlap the heat generating portion of the heat-insulated box in a thickness direction of the vacuum heat insulating material.

6. The refrigerator according to claim 4, wherein the heat-insulated box is provided with a refrigeration cycle, the refrigeration cycle including a compressor, heat radiation piping included in a condenser, a capillary tube, and a cooling device, and the heat generating portion is the heat radiation piping.

7. The refrigerator according to claim 6, wherein the heat radiation piping is disposed on a surface of the vacuum heat insulating material, and the gas adsorbent is disposed between at least two heat radiation pipes of the heat radiation piping.

8. The refrigerator according to claim 7, wherein the gas adsorbent is disposed on a surface of the vacuum heat insulating material, the surface being positioned at an opposite side to the surface on which the heat radiation piping is disposed.

9. A vacuum heat insulating material for use in a refrigerator, which is included in the refrigerator according to claim 1.

10. A refrigerator comprising:

a heat-insulated box including an inner casing and an outer casing, in which space between the inner casing and the outer casing is filled with a foamed heat insulating material; and a vacuum heat insulating material disposed in the heat-insulated box together with the foamed heat insulating material, the vacuum heat insulating material including an outer skin material, the outer skin material including at least a core material and being decompression-sealed, wherein the vacuum heat insulating material includes a gas adsorbent, and the vacuum heat insulating material is included in at least a side wall of the heat-insulated box, the heat-insulated box includes a plurality of vacuum heat insulating materials having different respective degrees of vacuum, a top surface and a back surface of the heat-insulated box are demarcated by a first top surface portion and a first back surface portion, respectively, and a recess is formed in a top portion of the heat-insulated box at the back surface side, the recess is provided at the back surface side of the first top surface portion and positioned lower than the first top surface portion, the recess including a second top surface portion and a second back surface portion, the second top surface portion being connected to a top of the first back surface portion, the second back surface portion connecting the first top surface portion and the second top surface portion, a compressor is disposed on the second top surface portion of the recess, and the vacuum heat insulating material including the gas adsorbent is disposed in the second back surface portion and/or the second top surface portion.

11. The refrigerator according to claim 10, wherein the vacuum heat insulating material including the gas adsorbent is disposed in one of heat insulating walls forming the second back surface portion and the second top surface portion, the one heat insulating wall having a less thickness than the other one of the heat insulating walls.

12. The refrigerator according to claim 10, wherein the vacuum heat insulating material including the gas adsorbent is disposed in one of heat insulating walls forming the second back surface portion and the second top surface portion, the one heat insulating wall having a larger area of projection onto an interior of the refrigerator than the other one of the heat insulating walls when each heat insulating wall is seen in a thickness direction thereof.

13. The refrigerator according to claim 10, wherein the vacuum heat insulating material including the gas adsorbent is disposed in one of heat insulating walls forming the second back surface portion and the second top surface portion, the one heat insulating wall being closer in distance to the compressor than the other one of the heat insulating walls.

* * * * *